US010808698B2

(12) United States Patent
Choi et al.

(10) Patent No.: US 10,808,698 B2
(45) Date of Patent: Oct. 20, 2020

(54) SCROLL COMPRESSOR HAVING COMMUNICATION GROOVE IN ORBITING END PLATE

(71) Applicant: LG ELECTRONICS INC., Seoul (KR)

(72) Inventors: Yong Kyu Choi, Seoul (KR); Cheol Hwan Kim, Seoul (KR); Kangwook Lee, Seoul (KR); Jungsun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 354 days.

(21) Appl. No.: 15/830,222

(22) Filed: Dec. 4, 2017

(65) Prior Publication Data

US 2018/0372099 A1 Dec. 27, 2018

(30) Foreign Application Priority Data

Jun. 23, 2017 (KR) ..... 10-2017-0080011

(51) Int. Cl.
*F04C 28/26* (2006.01)
*F04C 18/02* (2006.01)
(Continued)

(52) U.S. Cl.
CPC ..... *F04C 18/0215* (2013.01); *F01C 21/003* (2013.01); *F04C 15/0042* (2013.01);
(Continued)

(58) Field of Classification Search
CPC ..... F04C 18/0215; F04C 29/12; F04C 28/26; F04C 18/0261; F04C 28/10; F04C 18/0246; F04C 18/0253
(Continued)

(56) References Cited

U.S. PATENT DOCUMENTS 4,596,520 A 6/1986 Arata et al.
4,626,180 A 12/1986 Tagawa
(Continued)

FOREIGN PATENT DOCUMENTS

EP 1 526 283 4/2005
EP 2 369 182 9/2011
(Continued)

OTHER PUBLICATIONS

U.S. Office Action dated Nov. 14, 2019 issued in U.S. Appl. No. 15/830,290.
(Continued)

*Primary Examiner* — Deming Wan
(74) *Attorney, Agent, or Firm* — Ked & Associates LLP

(57) ABSTRACT

A scroll compressor, and more particularly, to a scroll compressor including a communication groove which may decrease discharge resistance is provided. The scroll compressor may include a fixed scroll having a fixed end plate and a fixed wrap, and an orbiting scroll configured to perform an orbiting movement about the fixed scroll and having an orbiting end plate and an orbiting wrap. A communication groove in the form of a recessed groove may be formed in an inner surface of the orbiting end plate, and a refrigerant may flow through the communication groove according to a state in which the fixed wrap overlaps the communication groove such that there is an effect in that an opening efficiency of a discharge hole is improved at an initial stage of discharge.

13 Claims, 25 Drawing Sheets

(51) Int. Cl.

| | |
|---|---|
| ***F04C 28/10*** | (2006.01) |
| ***F04C 23/00*** | (2006.01) |
| ***F04C 29/12*** | (2006.01) |
| ***F01C 21/00*** | (2006.01) |
| ***F04C 15/00*** | (2006.01) |
| ***F04C 29/00*** | (2006.01) |

(52) U.S. Cl.
CPC ..... *F04C 18/0261* (2013.01); *F04C 18/0269* (2013.01); *F04C 18/0292* (2013.01); *F04C 29/0021* (2013.01); *F04C 29/12* (2013.01)

(58) Field of Classification Search
USPC ..... 418/55.2
See application file for complete search history.

(56) References Cited

U.S. PATENT DOCUMENTS

| | | | | |
|---|---|---|---|---|
| 4,768,936 | A | 9/1988 | Etemad | |
| 4,898,521 | A | 2/1990 | Sakurai | |
| 5,803,722 | A * | 9/1998 | Noboru | F04C 18/023 418/55.5 |
| 6,273,691 | B1 | 8/2001 | Morimoto et al. | |
| 2009/0098000 | A1* | 4/2009 | Ignatiev | F04C 18/0215 418/1 |
| 2010/0122549 | A1 | 5/2010 | Cho | |
| 2012/0148434 | A1 | 6/2012 | Takabe et al. | |
| 2013/0078131 | A1 | 3/2013 | Ahn et al. | |
| 2013/0343941 | A1 | 12/2013 | Kim et al. | |
| 2014/0234148 | A1* | 8/2014 | Takeda | F04C 18/0215 418/55.2 |
| 2016/0040671 | A1 | 2/2016 | Choi et al. | |
| 2016/0040673 | A1 | 2/2016 | Lee et al. | |
| 2016/0047378 | A1 | 2/2016 | Choi et al. | |
| 2016/0053759 | A1 | 2/2016 | Choi et al. | |
| 2016/0108917 | A1 | 4/2016 | Bonnefoi | |
| 2016/0341249 | A1 | 11/2016 | Yang | |

FOREIGN PATENT DOCUMENTS

| | | |
|---|---|---|
| EP | 2 574 791 | 4/2013 |
| EP | 2 690 287 | 1/2014 |
| JP | S 62-178791 | 8/1987 |
| JP | H 03-202682 | 9/1991 |
| JP | H 07-054784 | 2/1995 |
| JP | H 08-303364 | 11/1996 |
| JP | H 08-303365 | 11/1996 |
| JP | H 10-169574 | 6/1998 |
| JP | 2009-036069 | 2/2009 |
| JP | 2010-180704 | 8/2010 |
| JP | 5 199951 | 5/2013 |
| KR | 10-1059880 | 8/2011 |
| KR | 10-2013-0034536 | 4/2013 |
| KR | 10-2016-0017539 | 2/2016 |
| WO | WO 97/17543 | 5/1997 |
| WO | WO 2014/198215 | 12/2014 |
| WO | WO 2015/085823 | 6/2015 |

OTHER PUBLICATIONS

United States Office Action dated Jan. 14, 2020 issued in co-pending related U.S. Appl. No. 15/830,135.
European Search Report dated Apr. 26, 2018 issued in Application No. 17199214.2.
Korean Office Action dated Aug. 20, 2018.
European Search Report dated Sep. 7, 2018.
European Search Report dated May 4, 2018 issued in Application No. 17204354.9.
European Search Report dated May 17, 2018 issued in Application No. 17205582.4.
Korean Office Action dated Jul. 16, 2018 issued in Application No. 10-2017-0075041.
United States Office Action dated Oct. 31, 2019 issued in co-pending related U.S. Appl. No. 15/830,161.
U.S. Office Action dated Apr. 30, 2020 issued in U.S. Appl. No. 15/830,290.
U.S. Appl. No. 15/830,135, filed Dec. 4, 2017.
U.S. Appl. No. 16/692,112, filed Nov. 22, 2019.
U.S. Appl. No. 15/830,161, filed Dec. 4, 2017.
U.S. Appl. No. 15/830,184, filed Dec. 4, 2017.
U.S. Appl. No. 16/692,088, filed Nov. 22, 2019.
U.S. Appl. No. 15/830,248, filed Dec. 4, 2017.
U.S. Appl. No. 15/830,290, filed Dec. 4, 2017.
European Office Action dated Feb. 6, 2020.

* cited by examiner

DISCHARGE START TIME

DISCHARGE START TIME + 10°

DISCHARGE START TIME + 20°

DISCHARGE START TIME + 30°

DISCHARGE START TIME + 40°

DISCHARGE START TIME

DISCHARGE START TIME + 10°

SCROLL COMPRESSOR HAVING COMMUNICATION GROOVE IN ORBITING END PLATE

CROSS-REFERENCE TO RELATED APPLICATION(S)

This application claims priority to and the benefit of Korean Patent Application No. 10-2017-0080011, filed in Korea on Jun. 23, 2017, the disclosure of which is incorporated herein by reference in its entirety.

BACKGROUND

1. Field

A scroll compressor is disclosed herein.

2. Background

Generally, a compressor is an apparatus configured to convert mechanical energy into compression energy of a compressible fluid. Compressors may be classified into a reciprocating compressor, a rotary compressor, a vane type compressor, and a scroll compressor according to a method of compressing a refrigerant.

A scroll compressor includes a fixed scroll having a fixed wrap and an orbiting scroll having an orbiting wrap engaged with the fixed wrap. That is, the scroll compressor is a compressor that suctions and compresses a refrigerant using a continuous volume change in a compression chamber formed between the fixed wrap and the orbiting wrap while the orbiting scroll performs an orbiting movement on the fixed scroll.

The scroll compressor is widely used for refrigerant compression in an air conditioning system, for example, due to its advantages of obtaining a relatively high compression ratio compared to other types of compressors and a stable torque because suction, compression, and discharge strokes of a refrigerant are smoothly performed. Behavior characteristics of the scroll compressor are determined by shapes of the fixed wrap and the orbiting wrap. Even though the fixed wrap and the orbiting wrap may have arbitrary shapes, the fixed wrap and the orbiting wrap generally have a form of an involute curve which is easy to process.

The orbiting scroll generally has an end plate formed in a circular plate shape and the orbiting wrap formed at one side surface of the end plate. In addition, the other side surface of the end plate, which doesn't have the orbiting wrap formed thereon, has a boss formed to have a predetermined height. In addition, an eccentric portion of a rotary shaft is coupled to the boss to orbitally drive the orbiting scroll. In such a structure, as the orbiting wrap may be formed over an approximate entire area of the end plate, there is an advantage in that a size of the end plate may be smaller than a size of an end plate of a structure having a same target compression rate.

However, in such a structure, as the orbiting wrap and the boss are spaced apart from each other in an axial direction, a position of an application point at which a repulsive force of a refrigerant is applied while the refrigerant is compressed and a position of an application point at which a reaction force for cancelling the repulsive force are different in the axial direction, the repulsive force and the reaction force act as two forces when the compressor is driven and incline the orbiting scroll. Thus, there is a disadvantage in that vibration or noise increases when the compressor is operated.

A scroll compressor in which a position at which an eccentric portion and an orbiting scroll of a rotary shaft are coupled is located on a same plane surface (a position at which the eccentric portion and the orbiting scroll overlap along a rotary shaft) as that of the orbiting wrap is disclosed in Korean Patent Registration No. 10-1059880, entitled "Scroll Compressor", which is hereby incorporated by reference, to solve such a problem. In the scroll compressor having a structure in which the eccentric portion is coupled to the rotary shaft at a level which is the same as a level at which the orbiting wrap is located on the basis of the rotary shaft, as a repulsive force of a refrigerant and a reaction force opposing the repulsive force have points of application at a same height and are applied in directions opposite to each other, a problem in which the orbiting scroll is inclined may be solved.

The scroll compressor includes a discharge hole configured to discharge a refrigerant compressed in each compression chamber. The compression chamber includes a first compression chamber formed at an outer side surface of the orbiting wrap, and a second compression chamber formed on an inner side surface of the orbiting wrap.

In a case in which one discharge hole is provided for a refrigerant compressed in the first compression chamber and a refrigerant compressed in the second compression chamber, a time at which a discharge hole opens for the first compression chamber and a time at which the discharge hole opens for the second compression chamber are different. Accordingly, there is a problem in that an over-compression loss occurs due to a discharge delay at a compression chamber from which a refrigerant is discharged relatively late.

A structure of forming each of a discharge hole of the first compression chamber and a discharge hole of the second compression chamber has been proposed in order to solve this problem. However, there is a problem in that it is difficult to secure an open area of the discharge hole of the second compression chamber at an initial stage of the discharge even when the discharge holes are individually formed.

BRIEF DESCRIPTION OF THE DRAWINGS

Embodiments will be described in detail with reference to the following drawings in which like reference numerals refer to like elements, and wherein.

DETAILED DESCRIPTION

Terms and words used in this specification and claims are not to be interpreted as being limited to commonly used meanings or meanings in dictionaries and should be interpreted as having meanings and concepts which are consistent with the technological scope based on the principle that the inventors have appropriately defined concepts of terms in order to describe embodiments in the best way. Moreover, as embodiments described in this specification and configurations illustrated in drawings are only exemplary embodiments and do not represent the overall technological, it should be understood that the embodiments covers various equivalents, modifications, and substitutions at the time of filing of this application.

Hereinafter, a scroll compressor according to embodiments will be described with reference to the accompanying drawings.

Figure 1:
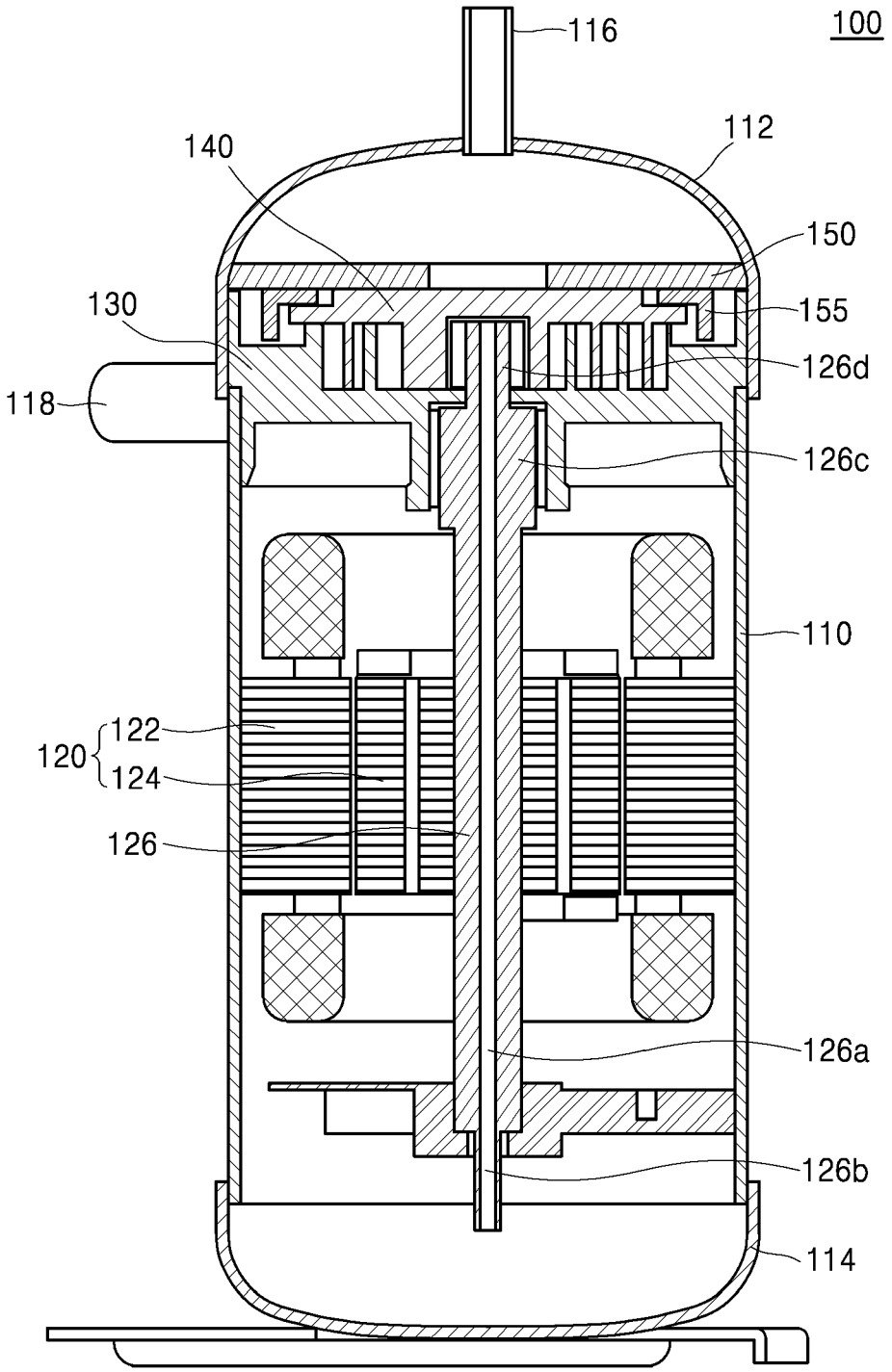
FIG. 1 is a schematic cross-sectional view of a scroll compressor according to an embodiment.
Figure 2:
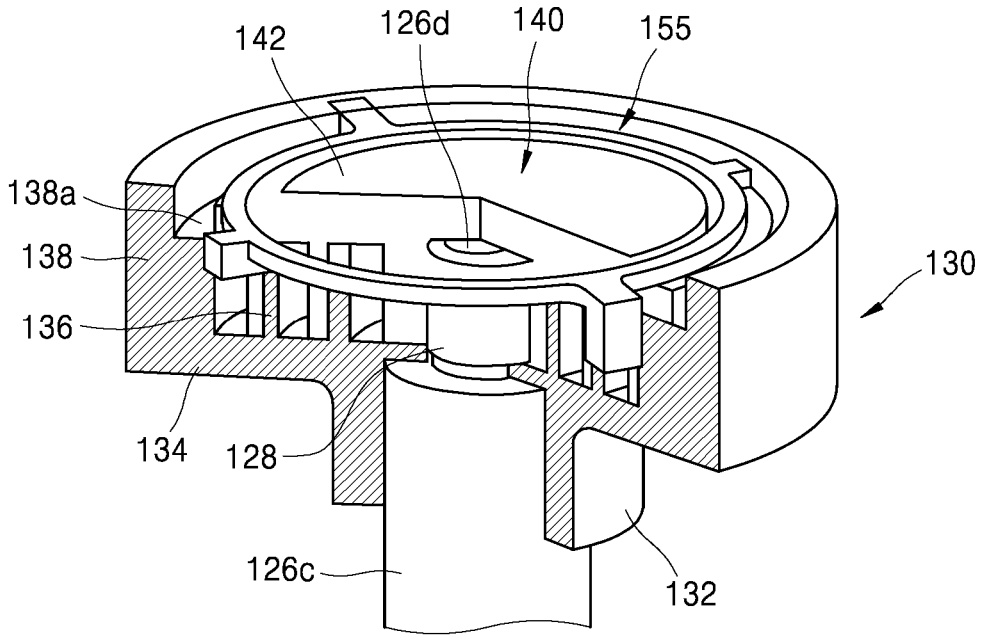
FIG. 2 is an enlarged cross-sectional view of a compression unit of the scroll compressor of FIG. 1.
Figure 3:
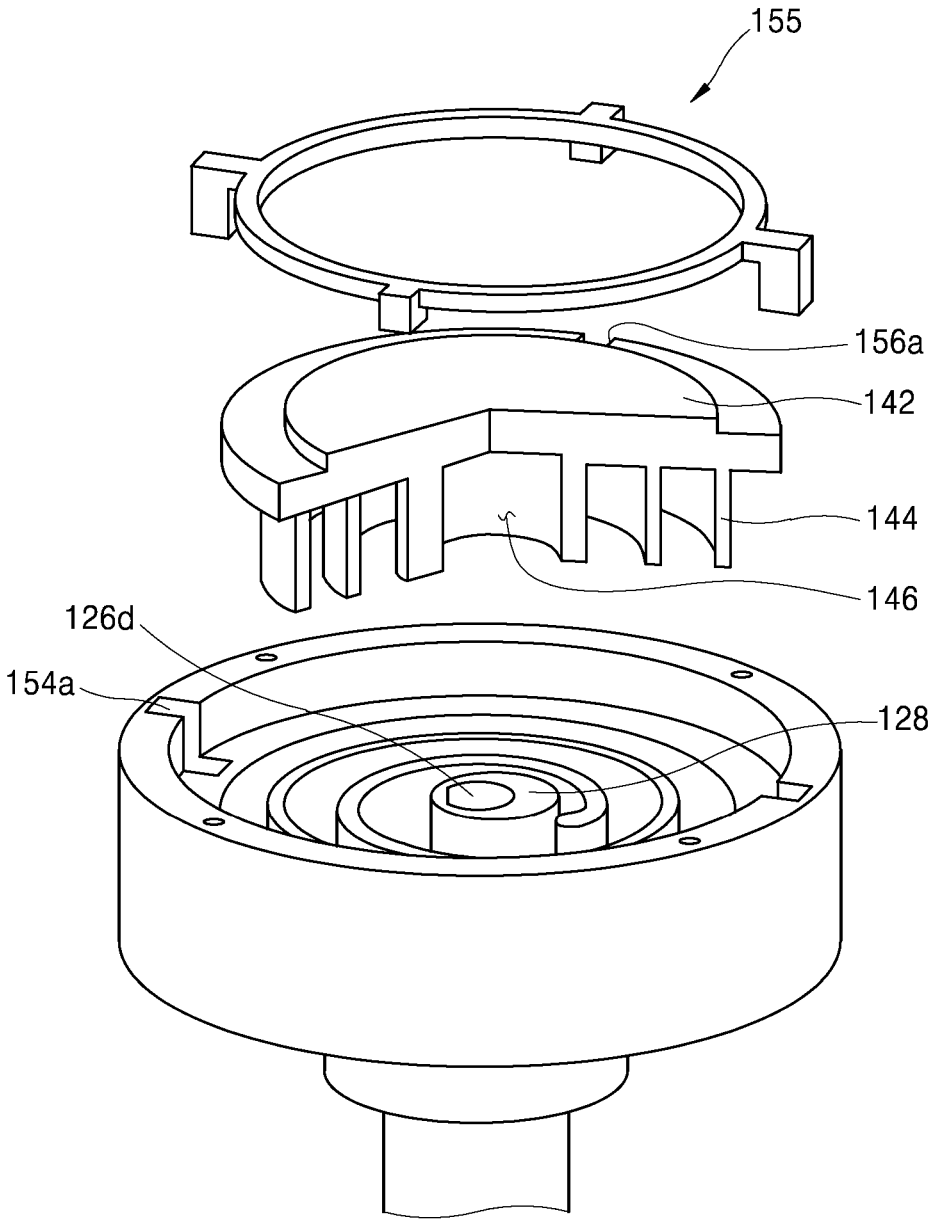
FIG. 3 is a partially cut perspective view of the compression unit of FIG. 2.

FIG. 1 is a schematic cross-sectional view of a scroll compressor according to an embodiment. FIG. 2 is an enlarged cross-sectional view illustrating a compression unit of the scroll compressor of FIG. 1. FIG. 3 is a partially cut perspective view of the compression unit of FIG. 2.

Referring to FIG. 1, a scroll compressor 100 according to an embodiment may include a cylindrical casing 110, and an upper shell 112 and a lower shell 114, which respectively cover a top and a bottom of the casing 110. The upper shell 112 and the lower shell 114 may be, for example, welded to the casing 110 to form a single sealed space with the casing 110.

A discharge pipe 116 may be disposed or provided at the upper shell 112. The discharge pipe 116 may form a path through which a compressed refrigerant may be discharged to the outside, and an oil separator (not shown) configured to separate oil which is mixed with the refrigerant from the refrigerant may be connected to the discharge pipe 116.

A suction pipe 118 may be disposed or provided at a side surface of the casing 110. The suction pipe 118 may be a path through which a refrigerant to be compressed may be introduced. The lower shell 114 may also serve as an oil chamber configured to store oil so that the compressor 100 may smoothly operate.

A drive motor 120 may be installed or provided at a top in the casing 110 as a drive unit. The motor 120 may include a stator 122 fixed to an inner surface of the casing 110 and a rotor 124 positioned in the stator 122 and configured to be rotated due to an interaction with the stator 122. A refrigerator flow channel may be formed between an outer circumferential surface of the stator 122 and the inner surface of the casing 110.

A rotary shaft 126 may be coupled to a center of the rotor 124, such that the rotor 124 and the rotary shaft 126 are integrated and rotate with each other. An oil flow channel 126*a* may be provided in a center of the rotary shaft 126 to extend in a longitudinal or axial direction of the rotary shaft 126, and an oil pump 126*b* to supply the oil stored in the lower shell 114 in an upward direction may be provided on or at a bottom end of the rotary shaft 126. Although not illustrated in the drawings, the oil pump 126*b* may include a spiral groove, a separate impeller, or an additional volumetric pump installed or provided in the oil path 126*a*.

Rotational power generated by the rotor 124 may be transferred to the compression unit through the rotary shaft 126. The compression unit may include a fixed scroll 130, an orbiting scroll 140, a main frame 150, and an Oldham ring 155.

The main frame 150 may be disposed over the drive motor 120 and form a top of the compression unit. The main frame 150 may be coupled to the fixed scroll 130, and the orbiting scroll 140 may be disposed between the main frame 150 and the fixed scroll 130 such that the orbiting scroll 140 may perform an orbiting movement.

The fixed scroll 130 may include a fixed end plate 134, a fixed scroll sidewall 138, and a fixed wrap 136. The fixed end plate 134 may have an approximately circular shape. The fixed scroll sidewall 138 may extend from an outer circumferential portion of the fixed end plate 134 toward the main frame 150 and be connected to the main frame 150.

The fixed wrap 136 may protrude above the fixed end plate 135. The fixed wrap 136 may be engaged with an orbiting wrap 144 of the orbiting scroll 140 to form a compression chamber.

The orbiting scroll 140 may include an orbiting end plate 142, the orbiting wrap 144, and a rotary shaft coupler 146. The orbiting end plate 142 may have an approximately circular shape and face the fixed end plate 134. The orbiting wrap 144 may protrude from a bottom surface of the orbiting end plate 142 toward the fixed end plate 134 and be engaged with the fixed wrap 136.

The rotary shaft coupler 146 may be disposed at a center of the rotary end plate 142 and be rotatably coupled to the eccentric portion EC of the rotary shaft 126. The rotary shaft coupler 146 may be formed to have a height overlapping the orbiting wrap 144 and be connected to the orbiting wrap 144. An outer circumferential portion of the rotary shaft coupler 146 may be connected to the orbiting wrap 144 and form the compression chamber with the fixed wrap 136 during a compression process. The compression process will be described hereinafter.

During compression, a repulsive force of a refrigerant is applied to the fixed wrap 136 and the orbiting wrap 144 and a compression force applied between a rotary shaft supporter and the eccentric portion EC as a reaction force. As described above, when a portion of the rotary shaft passes through the end plate and overlaps the wrap, the repulsive force of the refrigerant and the compression force are applied to a same side relative to the end plate, such that the forces cancel each other out. Due to this, tilting of the orbiting scroll caused by the effects of the compression force and the repulsive force may be prevented.

Also, although not shown in the drawings, a discharge hole may be formed at the fixed end plate 134 to allow a compressed refrigerant to be discharged into the casing 110. A position of the discharge hole may be arbitrarily determined in consideration of a necessary discharge pressure, for example.

Also, the Oldham ring 155 that prevents rotation of the orbiting scroll 140 may be provided above the orbiting scroll 140. The Oldham ring 155 may be provided between the main frame 150 and the orbiting scroll 140. The Oldham ring 155 may be key-coupled to each of the main frame 150 and the orbiting scroll 140 to prevent rotation of the orbiting scroll 140.

A refrigerant suctioned through the suction pipe 118 may be compressed in the compression chamber formed by the fixed scroll 130 and the orbiting scroll 140 and then discharged.

Hereinafter, before shapes of the fixed scroll and the orbiting scroll are described, a case in which the orbiting wrap and the fixed wrap have involute shapes will be described to facilitate an understanding of the embodiments.

Figure 4A:
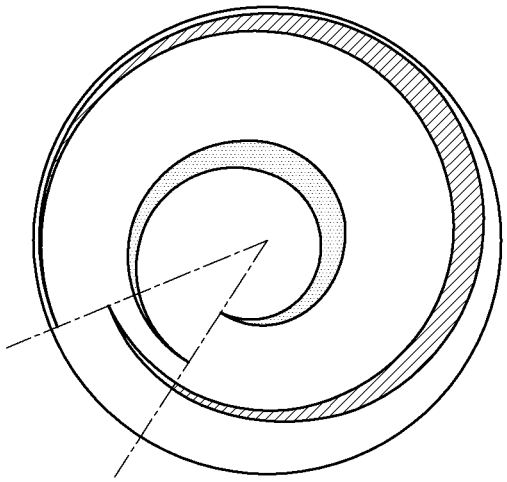
FIGS. 4A-4B are plan views illustrating first and second compression chambers of a scroll compressor including conventional orbiting and fixed wraps having involute shapes immediately after suction and immediately before discharge.
Figure 4B:
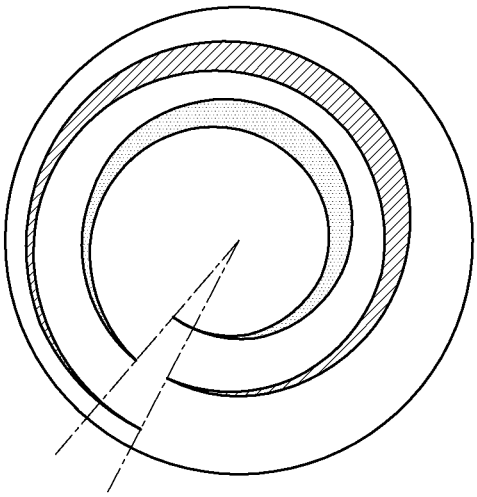

FIGS. 4A-4B are plan views illustrating first and second compression chambers of a scroll compressor which includes an orbiting wrap and a fixed wrap having involute curved lines and in which a portion of the rotary shaft passes through the end plate immediately after suction and immediately before discharge.

FIG. 4A is a view illustrating a change in a first compression chamber occurring between an inner side surface of the fixed wrap and an outer side surface of the orbiting wrap. FIG. 4B is a view illustrating a change in a second compression chamber occurring between the inner side surface of the fixed wrap and the outer side surface of the orbiting wrap.

The compression chambers of the scroll compressor are formed between two contact points generated by the fixed wrap coming into contact with the orbiting wrap, and in a case in which the scroll compressor includes the fixed wrap and the orbiting wrap having the involute curved lines, the two contact points which define the compression chamber are located on a same straight line, as illustrated in FIG. 4. In other words, the compression chambers are disposed 360° around a center of the rotary shaft.

When examining a volume change in the first compression chamber in FIG. 4A, a volume of the compression chamber is gradually decreased toward a central portion of the orbiting scroll by an orbiting movement of the orbiting scroll and has a minimum value when reaching an outer circumferential portion of the rotary shaft coupler located at a center of the orbiting scroll. In a case in which the scroll compressor includes the fixed wrap and the orbiting wrap which have involute curved lines, a rate of volume decrease is linearly decreased by an orbiting angle (hereinafter, referred to as a 'crank angle') of the rotary shaft being increased. Accordingly, the compression chamber has to be moved to be as close as possible to a center of the orbiting scroll to secure a high compression rate, but in a case in which the rotary shaft is located at the central portion of the orbiting scroll as described above, the compression chamber may be moved only up to the outer circumferential portion of the rotary shaft. Thus, the compression rate decreases.

Figure 5A:
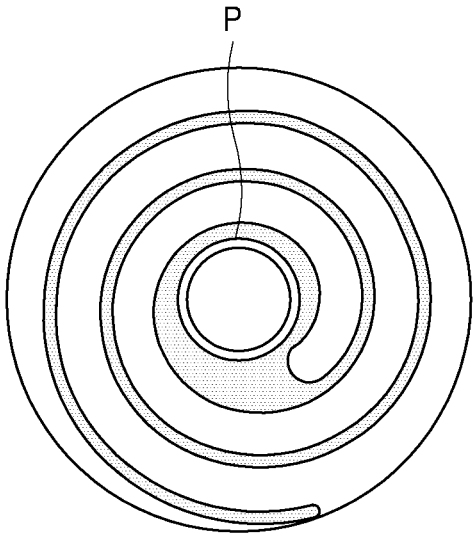
FIGS. 5A-5B are plan views illustrating shapes of an orbiting wrap of a scroll compressor including orbiting and fixed wraps having other involute shapes.
Figure 5B:
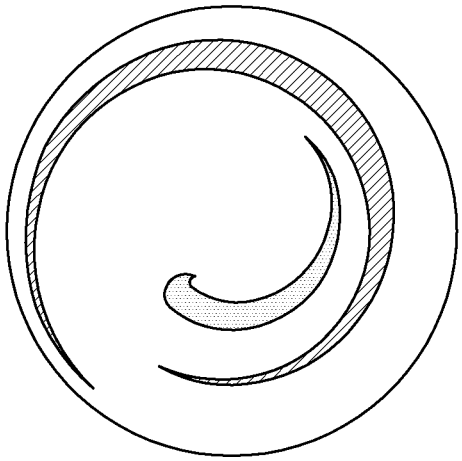

The second compression chamber illustrated in FIG. 4B has a lower compression rate than the first compression chamber. However, in a case of the second compression chamber, when a shape of the orbiting scroll is changed such that a connection portion between a rotary shaft coupler P and the orbiting wrap has an arc shape, as illustrated in FIG. 5A, a compression path of the second compression chamber is elongated before discharge such that the compression rate is increased. In this case, the second compression chamber is formed within a range of 360° immediately before discharge. However, it is impossible to apply such a method to the first compression chamber.

Accordingly, in the case in which the scroll compressor includes the fixed wrap and the orbiting wrap having involute shapes, a required level of compression rate of the second compression chamber may be obtained and a required level of compression rate of the first compression chamber may not be obtained, and in the case in which there is a significant difference in compression rate between the two compression chambers, an operation of the compressor is negatively influenced and an entire compression rate is also lowered.

To solve this problem, the fixed wrap and the orbiting wrap have different curved lines rather than the involute curved lines. FIGS. 6A to 6E are views illustrating a process of determining shapes of the fixed wrap and the orbiting wrap according to an embodiment, and a solid line denotes an envelope of a first compression chamber and a dotted line denotes an envelope of the second compression chamber in FIGS. 6A-6E. The term "envelope" refers to a trajectory drawn while a predetermined pattern moves, the solid line refers to a trajectory drawn by the first compression chamber during suction and discharge, and the dotted line refers to a trajectory drawn by the second compression chamber.

Accordingly, when the solid line is shifted an orbital radius of the orbiting scroll to either side in a parallel direction, a shape of an inner side surface of the fixed wrap and a shape of an outer side surface of the orbiting wrap are formed, and when the dotted line is shifted an orbital radius of the orbiting scroll to either side in a parallel direction, a shape of an outer side surface of the fixed wrap and a shape of an inner side surface of the orbiting wrap are formed.

Figure 6A:
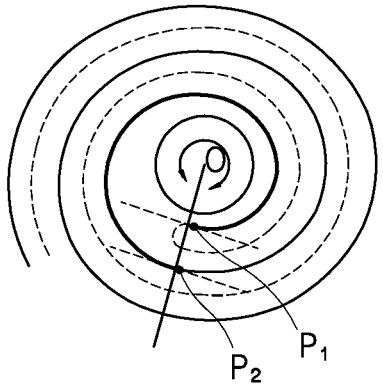
FIGS. 6A-6E are explanatory diagrams illustrating a process of obtaining an envelope of an example of the scroll compressor according to an embodiment.

FIG. 6A is a view illustrating envelopes corresponding to a case in which wraps have the shapes illustrated in FIG. 5A. A portion denoted by a bold line corresponds to the first compression chamber immediately before discharge, and a starting point and an ending point are located on one straight line as illustrated in the drawing. In this case, it is difficult to obtain a significant compression rate.

Figure 6B:
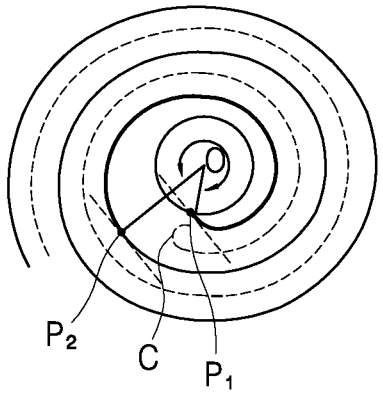

As illustrated in FIG. 6B, an end which is located at an outer side of the bold line is moved along the envelope in a clockwise direction, and an end which is located at an inner side thereof is moved to a point in contact with the rotary shaft coupler. That is, a portion of the envelope is adjacent to the rotary shaft coupler and bent to have a relatively small radius of curvature.

As described above, the compression chamber is defined by two contact points at which the orbiting wrap meets the fixed wrap according to a characteristic of the scroll compressor. In FIG. 6A, both of the ends of the bold line correspond to the two contact points, and normal vectors at the contact points are in parallel based on an operational principle of a scroll compressor. In addition, the normal vectors are also in parallel to a line that connects a center of the rotary shaft and a center of the eccentric bearing. However, when the fixed wrap and the orbiting wrap have involute shapes, the two normal vectors are in parallel and are the same as illustrated in FIG. 6A.

That is, in FIG. 6A, when a center O indicates the center of the rotary shaft coupler 146 and points $P_1$ and $P_2$ indicate two contact points, the point $P_2$ is located on a straight line which connects the center O and the point $P_1$, and when an angle $\alpha$ denotes a large angle among angles defined by lines $OP_1$ and $OP_2$, the angle $\alpha$ is 360°. In addition, when a distance l indicates a distance between the normal vectors at the points $P_1$ and $P_2$, the distance l is zero.

When the points $P_1$ and $P_2$ are moved further inwardly along the envelope, a compression rate of the first compression chamber may be increased. To this end, when the point $P_2$ is moved toward the rotary shaft coupler 146, in other words, the envelope of the first compression chamber is bent and moved toward the rotary shaft coupler 146, the point $P_1$ having a normal vector, which is parallel to a normal vector at the point $P_2$, is located at a position which is moved from a position of the point $P_1$ by being rotated in the clockwise direction in FIG. 6.

Figure 6C:
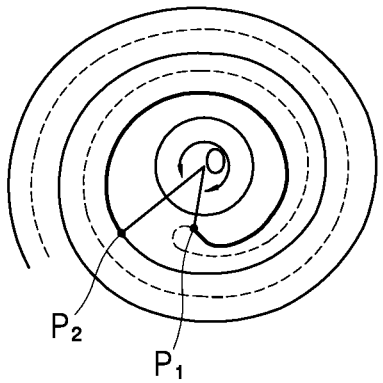
Figure 6D:
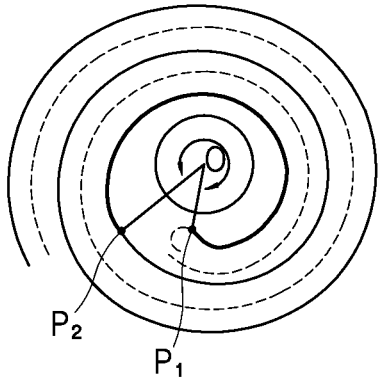

As described above, as a volume of the first compression chamber is decreased toward an inner side thereof along the envelope, the first compression chamber of FIG. 6B is moved inwardly from that of FIG. 6A and is correspondingly more compressed, and thus, a compression rate thereof increases. In the case of FIG. 6B, as the point $P_2$ is very close to the rotary shaft coupler 146, the rotary shaft coupler 146 has a small thickness and is not sufficiently strong such that the envelope is changed to be as shown in FIG. 6C by the point $P_2$ being moved backwards. However, as the envelopes of the first compression chamber and the second compression chamber are very close to each other in FIG. 6C, thicknesses of the wraps are excessively small or the wraps may not be physically formed such that the envelope of the second compression chamber has to be changed to maintain a predetermined distance between the two envelopes, as illustrated in FIG. 6D.

Figure 6E:
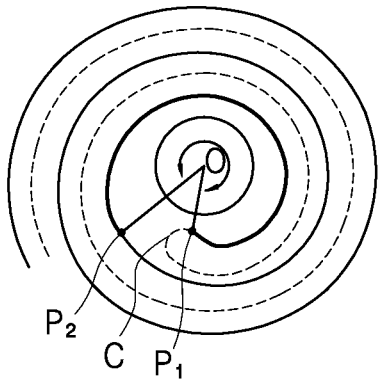

In addition, an arc portion c which is located at an end of the envelope of the second compression chamber is changed to be in contact with the envelope of the first compression chamber, as illustrated in FIG. 6E. In addition, when the two envelopes are changed to have a predetermined distance between the two entire envelopes and a radius of the arc portion c of the envelope of the second compression chamber is increased to secure a wrap strength of an end of the fixed wrap, envelopes having shapes illustrated in FIG. 7 are obtained.

Figure 7:
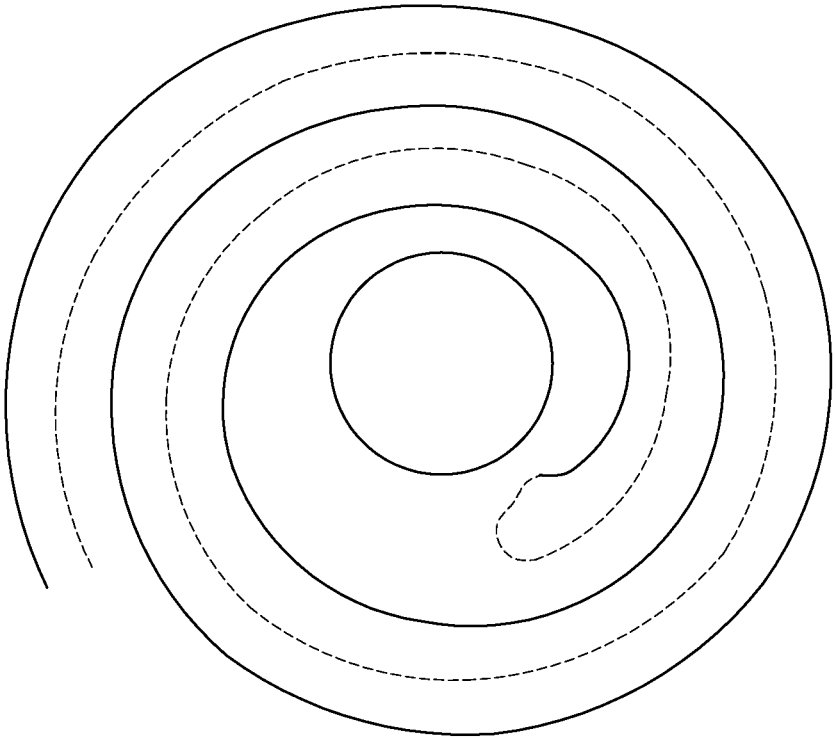
FIG. 7 is a plan view illustrating a final envelope of the example illustrated in FIGS. 6A-6E.
Figure 8:
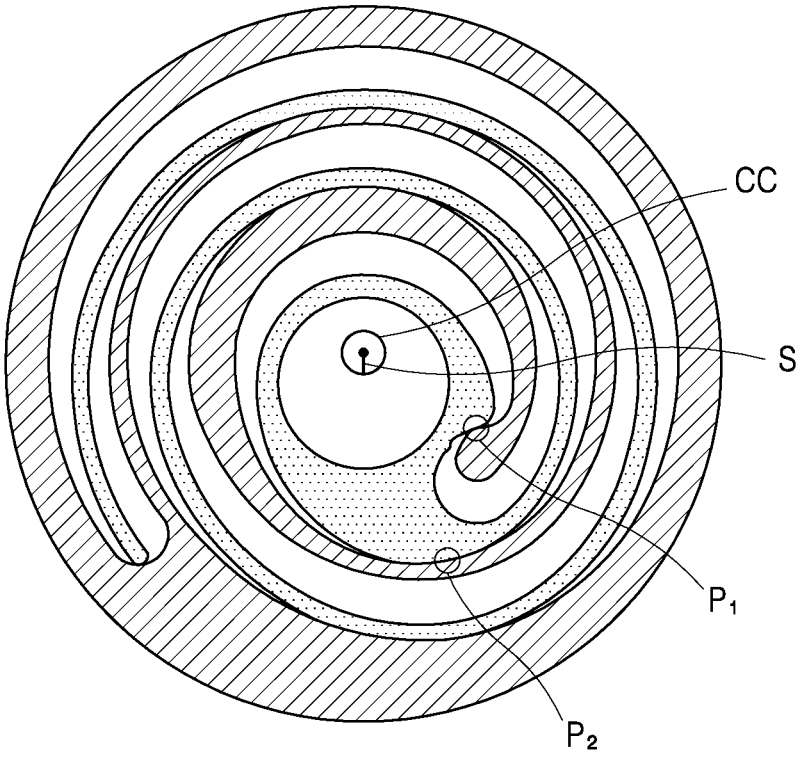
FIG. 8 is a plan view illustrating an orbiting wrap and a fixed wrap obtained using the envelope illustrated in FIG. 7.
Figure 9:
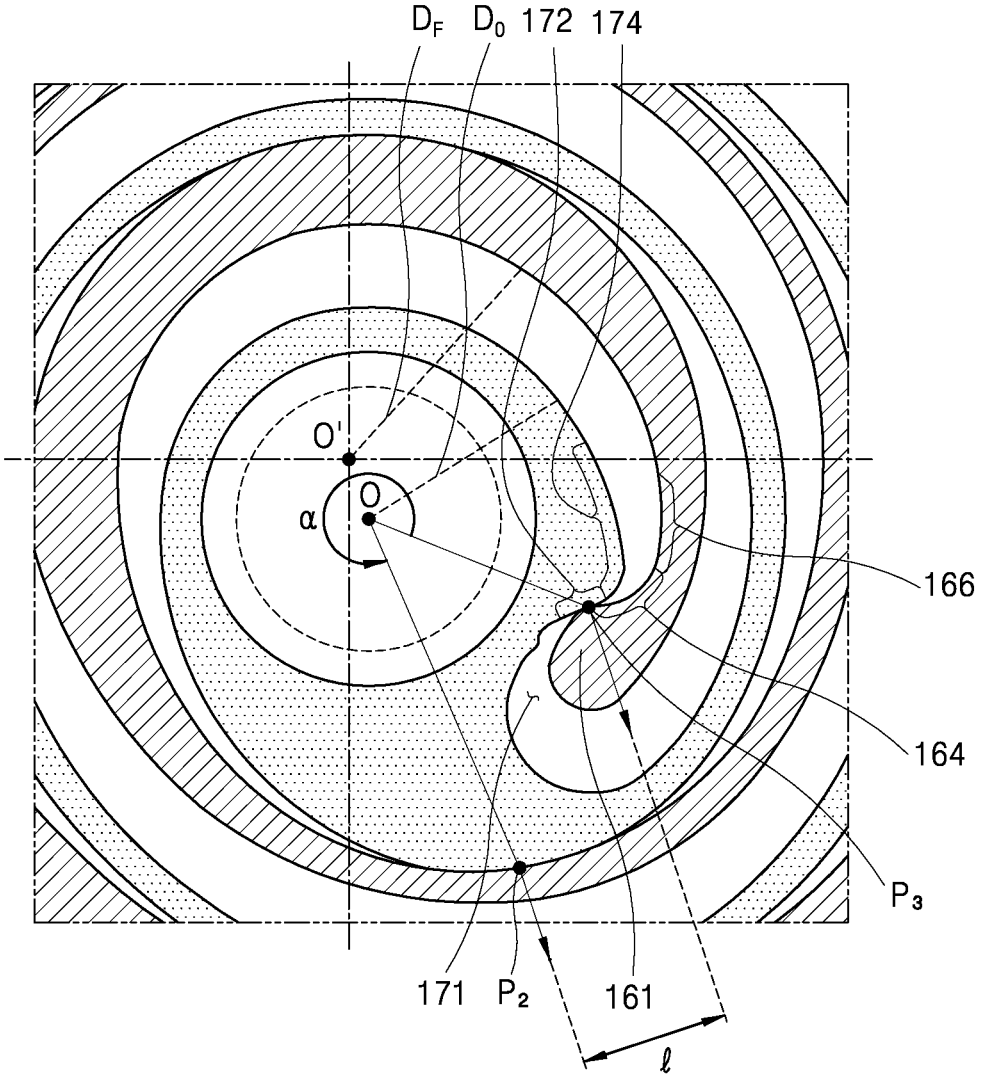
FIG. 9 is an enlarged plan view illustrating a central portion of FIG. 8.

FIG. 8 is a plan view illustrating the completed orbiting wrap and fixed wrap based on the envelopes illustrated in FIG. 7. FIG. 9 is an enlarged plan view illustrating a central portion of FIG. 8.

FIG. 8 is a view illustrating a position of the orbiting wrap at a time at which discharge from the first compression chamber is started. The point $P_1$ in FIG. 8 is a point located at an inner side of two contact points which define the first compression chamber in the case in which the discharge from the first compression chamber is started, and the point $P_1$ is specifically referred to as contact point $P_3$ in FIG. 9. In addition, line S indicates a virtual line for indicating a position of the rotary shaft 126, and circle C indicates a trajectory drawn by the line S.

Hereinafter, when the line S is disposed in a state illustrated in FIG. 8, that is, the discharge is started, a crank angle is defined as 0°, and the crank angle is defined to have a negative (−) value when the line S rotates in a counterclockwise direction and the crank angle is defined to have a positive (+) value when the line S rotates in a clockwise direction.

Referring to FIGS. 8 and 9, an angle $\alpha$ defined by two straight lines which connect two contact points $P_1$ and $P_2$ to the center O of the rotary shaft coupler is less than about 360°, and a distance l between normal vectors at the contact points is greater than 0. Accordingly, as the first compression chamber has a volume less than a volume of the first compression chamber including the fixed wrap and the orbiting wrap having involute curved lines immediately before the discharge, a compression rate increases. In addition, the orbiting wrap and the fixed wrap illustrated in FIG. 8 have shapes in which a plurality of arcs having different diameters and starting points are connected, and outermost curved lines thereof have substantially oval shapes having long and short axes.

In this embodiment, the angle $\alpha$ is set to be in a range of about 270° to 345°. It is advantageous for the angle $\alpha$ to be set to be small from a viewpoint of increasing a compression rate, but as a machining process is difficult when the angle is set to be less than about 270°, there is a problem in that a cost of the compressor increases. In addition, when the angle $\alpha$ is greater than about 345°, the compression rate decreases to be 2.1 or less so that a sufficient level of compression rate may not be provided.

In addition, a protrusion 161 that protrudes toward the rotary shaft coupler 146 may be formed near an inner end of the fixed wrap. That is, the inner end of the fixed wrap may be formed to have a thickness greater than a thickness of other portions. Accordingly, a strength of the inner end of the fixed wrap that receives the biggest compressive force may be increased such that durability of the wrap may be improved.

Meanwhile, as illustrated in FIG. 9, a thickness of the fixed wrap 136 at the protrusion 161 gradually decreases from the contact point $P_3$ located at an inner side of the two contact points forming the first compression chamber at the time at which the discharge is started. More specifically, a first decreasing portion 164 adjacent to the contact point $P_3$, and a second decreasing portion 166 connected to the first decreasing portion 164 are formed, and a rate of thickness decrease of the first decreasing portion 164 is greater than a rate of thickness decrease of the second decreasing portion 166. In addition, the thickness of the fixed wrap 136 increases within a predetermined section beyond the second decreasing portion 166.

Figure 12:
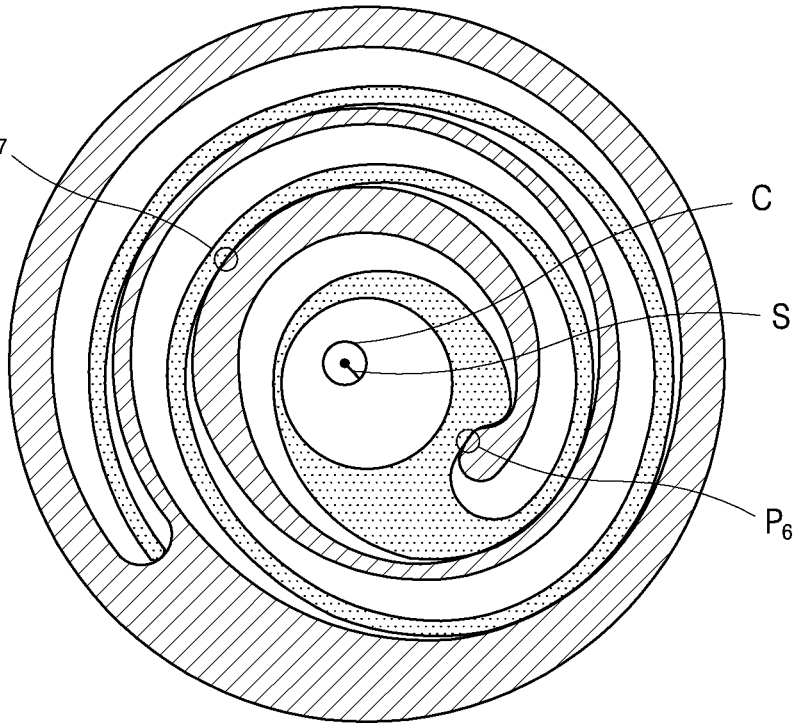
FIG. 12 is a plan view illustrating a state at a time at which discharge from a second compression chamber is started in the example illustrated in FIG. 8.

In addition, when a distance $D_F$ refers to a distance between an inner side surface of the fixed wrap 136 and an axial center O of the rotary shaft 126, the distance $D_F$ decreases after increasing from the contact point $P_3$ in a counterclockwise direction (see FIG. 9), and a section in which the distance $D_F$ is changed is illustrated in FIG. 12. FIG. 12 is a plan view illustrating a position of the orbiting wrap in a case in which the crank angle of the rotary shaft is about 150° before the discharge is started, that is, the crank angle is about 150°.

Figure 11:
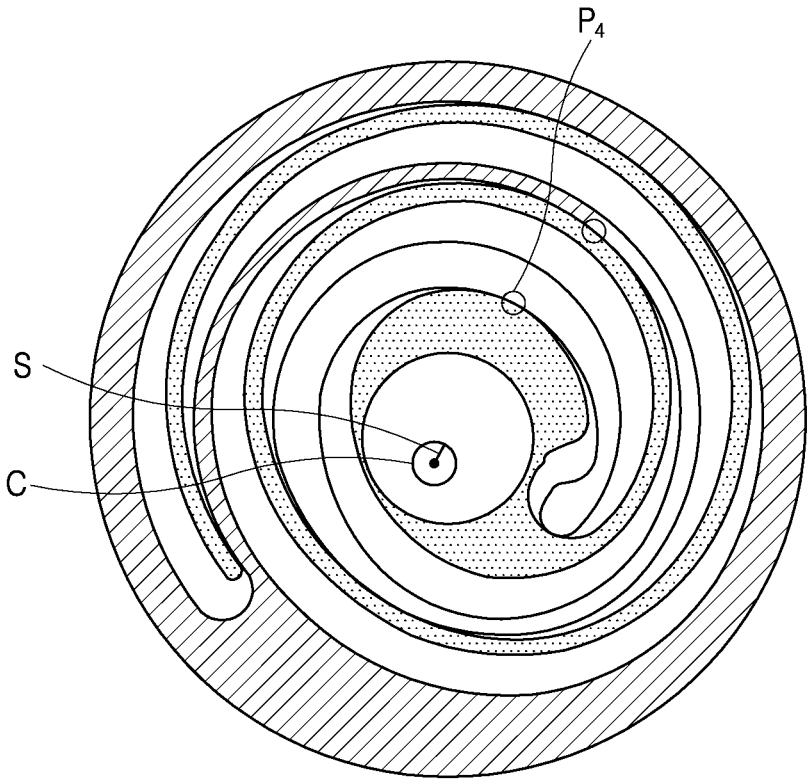
FIG. 11 is a plan view illustrating a state in which a crank angle is about 150°.

When the rotary shaft further rotates 150° from the state of FIG. 12, the state illustrated in FIG. 8 occurs. Referring to FIG. 11, a contact point $P_4$, which is located at the inner side of two contact points forming the first compression chamber, is located above the rotary shaft coupler 146, and $D_F$ decreases after increasing in a section between the contact point $P_3$ in FIG. 9 and the contact point $P_4$ in FIG. 11.

A recess 171 engaged with the protrusion 161 is formed in the rotary shaft coupler 146. One sidewall of the recess 171 comes into contact with the protrusion 161 and forms a contact point of one side of the first compression chamber. When a distance from the center O of the rotary shaft coupler 146 to an outer circumferential portion of the rotary shaft coupler 146 is referred to as a distance Do, the distance Do decreases after increasing in a section between the contact point $P_3$ in FIG. 9 and the contact point $P_4$ in FIG. 11. Similarly, a thickness of the rotary shaft coupler 146 also decreases after increasing in the section between the contact point $P_3$ in FIG. 9 and the contact point Pain FIG. 11.

In addition, one sidewall of the recess 171 includes a first increasing portion 172, in which a thickness of one sidewall relatively quickly increases, and a second increasing portion 174, which is connected to the first increasing portion 172 and in which a thickness thereof increases at a relatively low rate. The first increasing portion 172 and the second increasing portion 174 respectively correspond to the first decreasing portion 164 and the second decreasing portion 166 of the fixed wrap 136. The first increasing portion 172, the first decreasing portion 164, the second increasing portion 174, and the second decreasing portion 166 are formed on the basis of a result of bending the envelope toward the rotary shaft coupler 146 at a stage of FIG. 6B. Accordingly, the point $P_1$, that is, an inner contact point, forming the first compression chamber is located at the first increasing portion 172 and the second increasing portion 174, and a length of the first compression chamber is decreased immediately before the discharge, and the compression rate of the first compression chamber may increase as a result thereof.

The other sidewall of the recess 171 is formed to have an arc shape. A diameter of the arc is defined by a thickness of the end of the fixed wrap 136 and an orbiting radius of the orbiting wrap 144, and when the thickness of the end of the fixed wrap 136 is increased, the diameter of the arc is increased.

Accordingly, a thickness of the orbiting wrap adjacent to the arc is also increased such that durability thereof may be secured. In addition, a compression path is elongated such that there is an advantage in that the compression rate of the second compression chamber is correspondingly increased.

Figure 14:
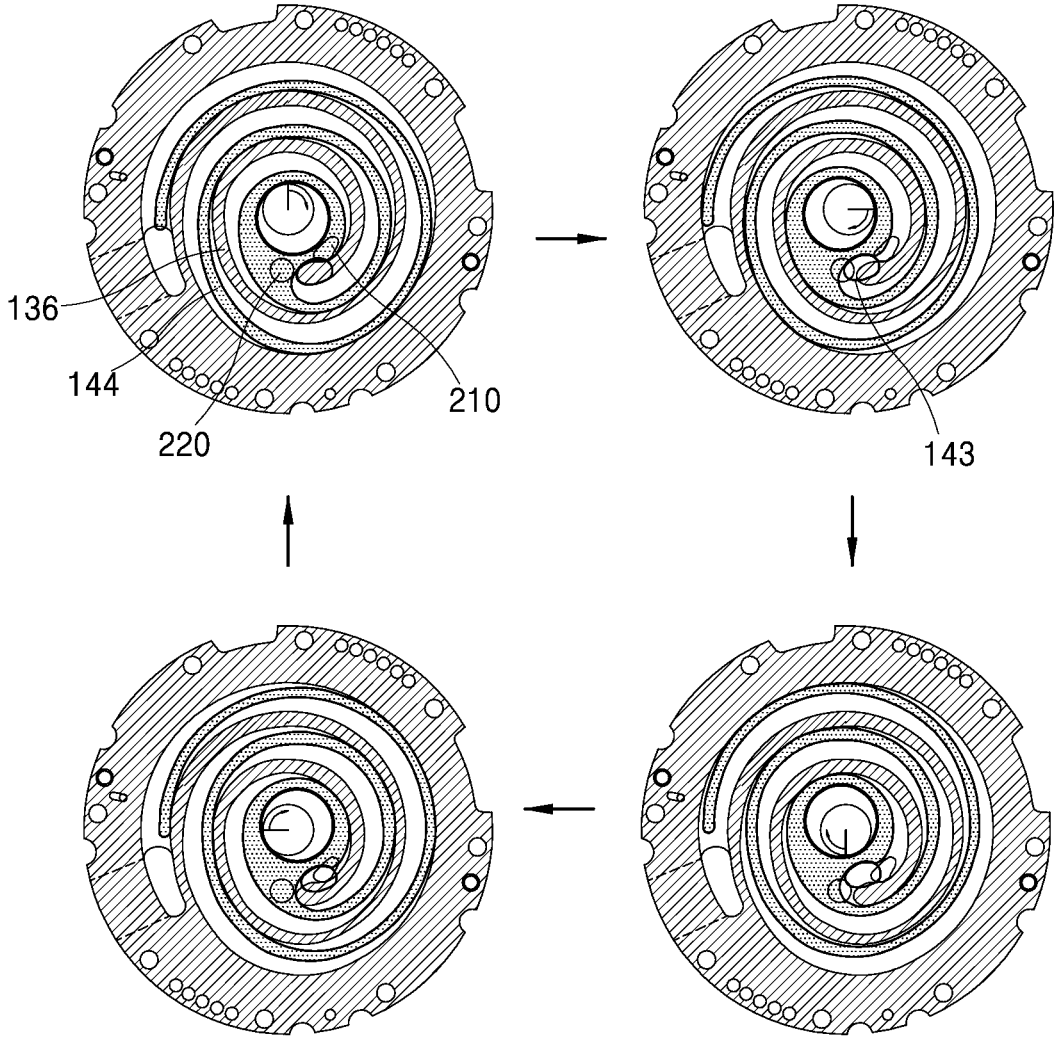
FIG. 14 is a view illustrating an orbiting motion of the orbiting scroll of the scroll compressor according to an embodiment.

The central portion of the recess 171 forms a part of the second compression chamber. FIG. 14 is a plan view illustrating a position of the orbiting wrap at a time at which discharge from the second compression chamber is started, and the second compression chamber is defined by two contact points $P_6$ and $P_7$ in FIG. 12 and is in contact with the arc-shaped sidewall of the recess 171, and one end of the second compression chamber passes the central portion of the recess 171 when the rotary shaft 126 rotates a little more.

Figure 10:
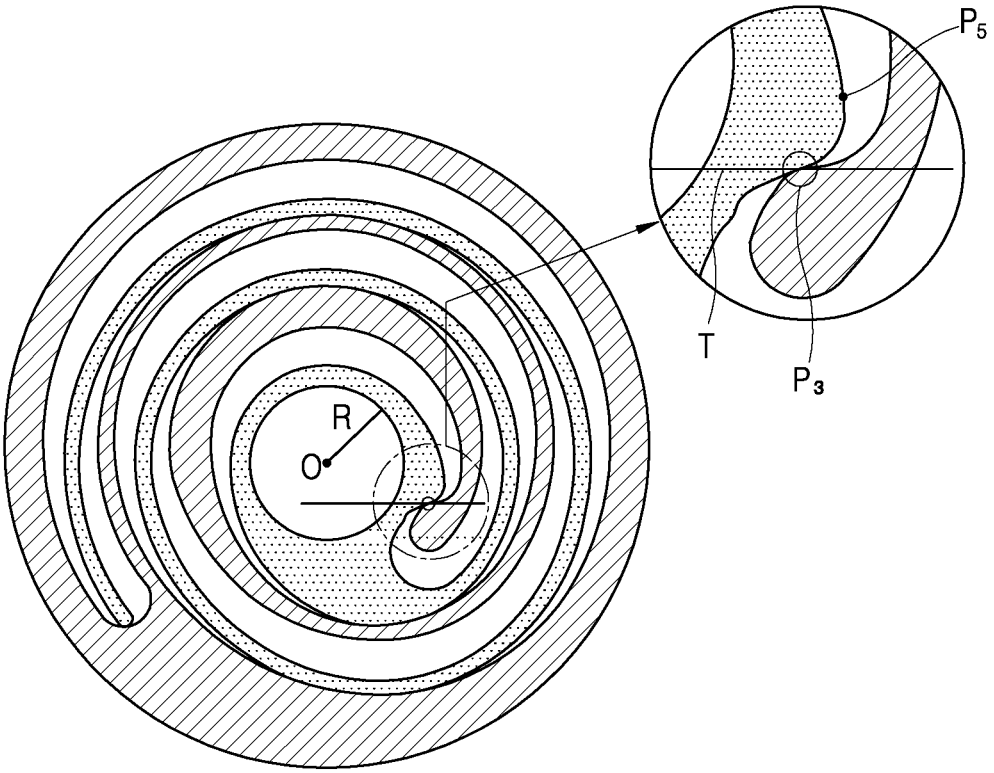
FIG. 10 is another enlarged plan view illustrating the central portion of FIG. 8.

FIG. 10 is another plan view illustrating the state illustrated in FIG. 9, and it may be seen that a tangent line T drawn at the contact point $P_3$ passes through an inside of the rotary shaft coupler 146 with reference to FIG. 10. Such a result is obtained as the result of bending the envelope inward in the process of FIG. 6B, and a distance between the tangent line T and the center of the rotary shaft coupler 146 is less than an inner diameter of the rotary shaft coupler 146.

In addition, a contact point $P_5$ indicates an inner contact point in FIG. 10 when the crank angle is about 90°, and as illustrated in the drawings, a radius of curvature of the outer circumferential portion of the rotary shaft coupler 146 may have any value according to a position between the contact point $P_3$ and the contact point $P_5$.

Generally, an air conditioning compressor may have a compression rate of about 2.3 or more when used in a combined cooling and heating apparatus and about 2.1 or more when used in a cooling apparatus. Although the contact point $P_5$ is not limited to the case in which the crank angle is about 90°, as a degree of design freedom for a radius of curvature is decreased for an angle of more than about 90° on the basis of an operational principle of the scroll compressor, it is advantageous to change a shape thereof between 0° to 90° in which the degree of design freedom is relatively high to improve the compression rate.

Hereinafter, a discharge structure for discharging a refrigerant compressed in the first compression chamber and the second compression chamber will be described.

As compression of the first compression chamber and the second compression chamber is performed according to the envelopes, the refrigerant compressed in the first compression chamber and the refrigerant compressed in the second compression chamber are respectively discharged from the compression chambers through the first discharge hole and the second discharge hole and move to an inside of the casing. Each of the discharge holes may be arbitrarily set in consideration of a required discharge pressure.

The discharge hole may be formed in the fixed end plate of the fixed scroll in a form of a through hole. A discharge inlet refers to a discharge hole of a side of the compression chamber which is an inner surface (a surface facing the orbiting scroll) of the fixed end plate, and a discharge outlet refers to a discharge hole of an outer surface (a surface facing the casing) of the fixed end plate.

However, as described above, as an inner portion of the second compression chamber has a bent shape, there is a limitation in securing an open area of the second discharge inlet at a time at which the discharge from the second compression chamber is started. When the open area of the discharge inlet is not sufficiently secured, an excessive discharge loss occurs and causes a performance reduction of the entire compressor.

Embodiments disclosed herein provide a structure capable of reducing discharge resistance of the second compression chamber at an initial discharge stage of additionally discharging a refrigerant compressed in the second compression chamber through the first discharge hole for discharging a refrigerant in the first compression chamber. Movement of a compressed refrigerant occurs due to a pressure difference, and at this time, a flow rate and a flow speed thereof are defined by the pressure difference and a cross-sectional area of a flow path. Accordingly, when an open area of discharge hole is insufficiently secured, the discharge resistance is increased such that a required discharge flow rate may not be secured.

To solve such a problem, the scroll compressor according to embodiments includes a communication groove, which allows the refrigerant compressed in and discharged from the second compression chamber at an initial stage of the discharge of the second compression chamber to move to the first discharge hole, in the end plate of the orbiting scroll.

The communication groove may be in the form of a recessed groove in the orbiting end plate of the orbiting scroll. Hereinafter, the recessed groove for moving the compressed refrigerant in the orbiting end plate is referred to as a "communication groove".

The communication groove may be formed by being processed in a recessed shape in an inner surface of the orbiting end plate. The inner surface of the orbiting end plate comes into contact with an upper surface of the fixed wrap to form the compression chamber, and when the communication groove in the recessed shape is provided in the orbiting end plate and an upper surface of the fixed wrap does not fully cover the communication groove, the refrigerant may move between portions at which the communication groove deviates from the upper surface of the fixed scroll. In other words, the refrigerant may flow through the communication groove and move between the portions at which the communication groove deviates from the fixed wrap.

Such a communication groove may be formed in the orbiting end plate, and as a relative position of the communication groove is changed with respect to the fixed wrap according to an orbiting movement of the orbiting scroll (a change in the crank angle), the refrigerant may move along the upper surface of fixed wrap through the communication groove at a specific position of the orbiting scroll when a position at which the communication groove is formed and a shape of the communication groove are adjusted.

Figure 13A:
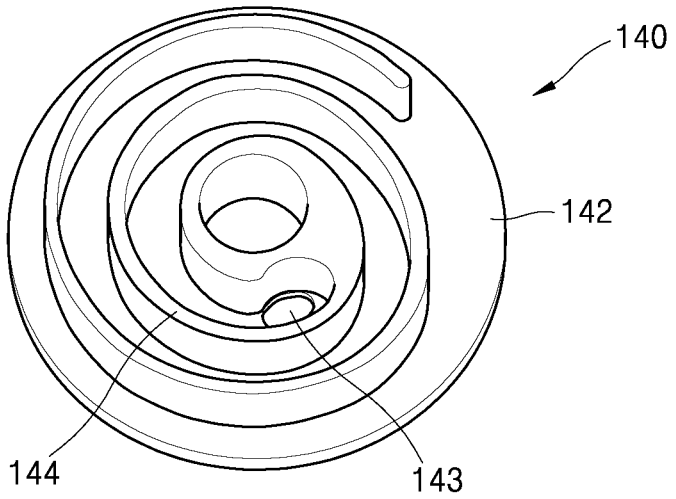
FIGS. 13A-13B are view illustrating a fixed scroll and an orbiting scroll of a scroll compressor according to an embodiment.
Figure 13B:
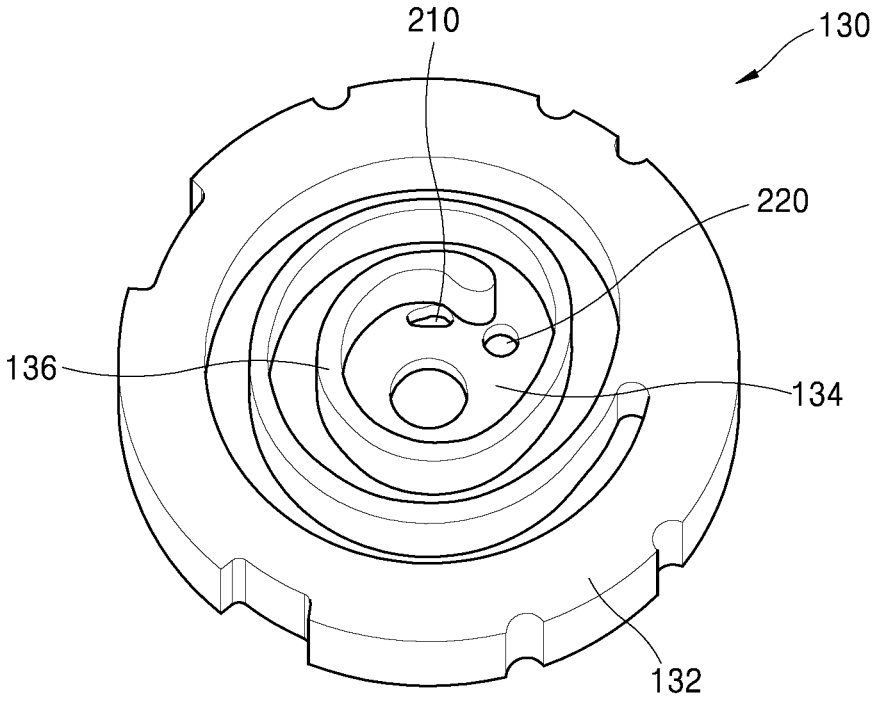

FIGS. 13A-13B are views illustrating a fixed scroll and an orbiting scroll of the scroll compressor according to an embodiment. FIG. 14 is a view illustrating an orbiting motion of the orbiting scroll of the scroll compressor according to an embodiment.

The fixed scroll 130 may include the fixed end plate 134 in a circular plate shape and the fixed wrap 136, and the orbiting scroll 140 may include the orbiting end plate 142 in a circular plate shape and the orbiting wrap 144. A first discharge hole 210 and a second discharge hole 220 may be formed in the fixed end plate 134 in the form of a through hole.

As described above, the first discharge hole 210 may serves to discharge the refrigerant compressed in the first compression chamber to an outside of the compression chamber, and the second discharge hole 220 may serve to discharge the refrigerant compressed in the second compression chamber to an outside of the compression chamber. When the first discharge hole 210 enters a region of the first compression chamber, the refrigerant compressed in the first compression chamber may be discharged to an inside of a frame through the first discharge hole 210. Similarly, when the second discharge hole 220 enters a region of the second compression chamber, the refrigerant compressed in the second compression chamber may be discharged to the inside of the frame through the second discharge hole 220.

Figure 15:
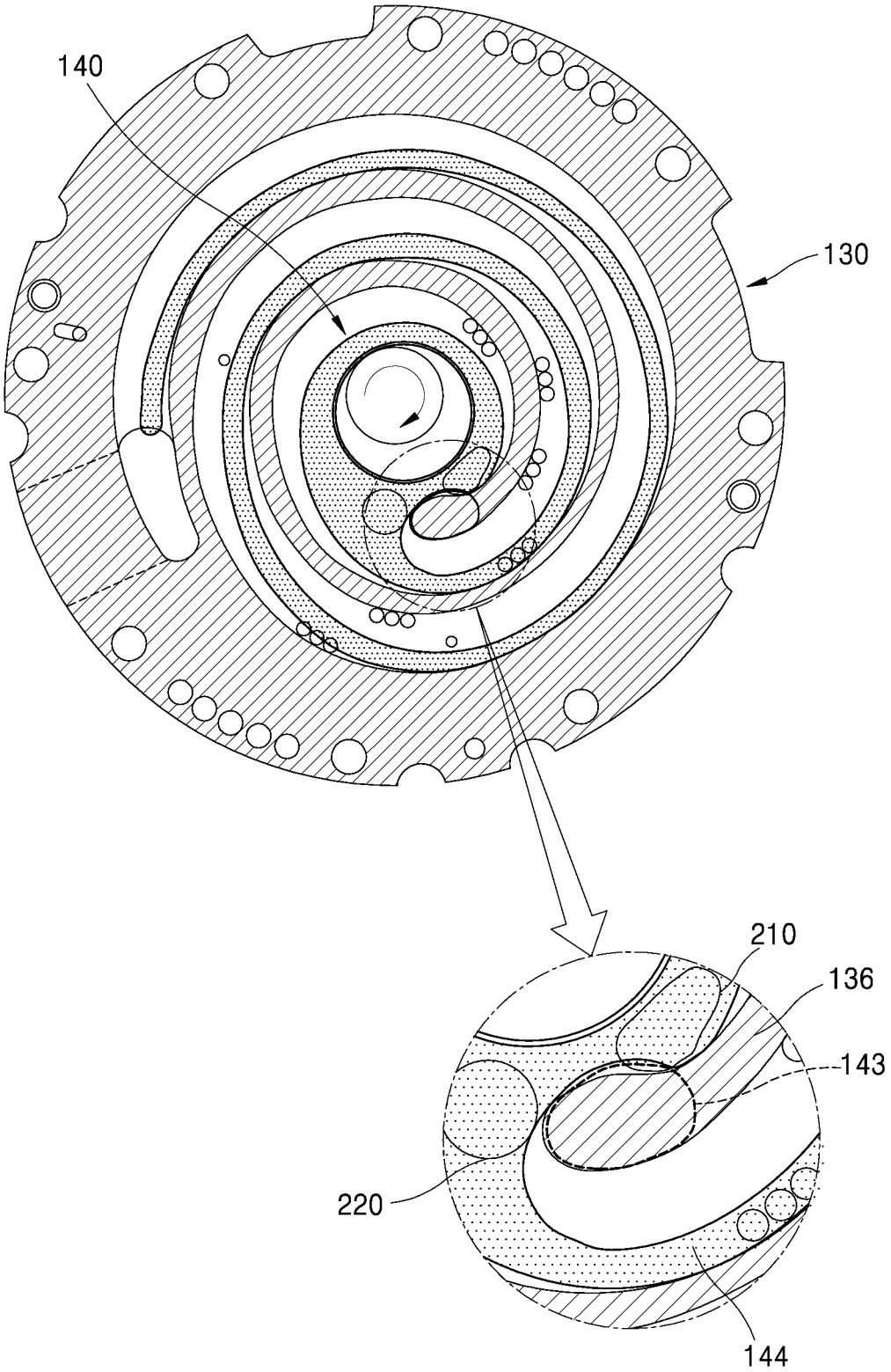
FIGS. 15 to 19 are views illustrating states in which a crank angle is incrementally increased about 10° in a clockwise direction on the basis of FIG. 15 illustrating a state at a time at which discharge from the second compression chamber is started.

In the case of the illustrated embodiment, the orbiting scroll 140 rotates in a clockwise direction. FIG. 15 is a view illustrating a state at a time at which the discharge from the second compression chamber is started. FIGS. 15 to 19 are views illustrating states in which the orbiting scroll incrementally rotates 10° from a crank angle at the time at which the discharge from the second compression chamber is started.

Referring to FIG. 15, although the second discharge hole 220 is fully covered by the orbiting wrap 144 of the orbiting scroll 140, when the orbiting scroll 140 rotates more, the second discharge hole 220 enters an inside of the second compression chamber and the discharge is started. As the discharge from the second compression chamber is started at the state illustrated in FIG. 15, a time at which the state illustrated in FIG. 15 is generated may be referred to as a "discharge start time".

At the discharge start time of FIG. 15, as the communication groove 143 formed in the orbiting end plate 142 is located on an upper surface of the fixed wrap 136, the refrigerant does not move through the communication groove 143. In other words, at the discharge start time, there are no regions in which the communication groove 143 overlaps the inside of the second compression chamber.

Figure 16:
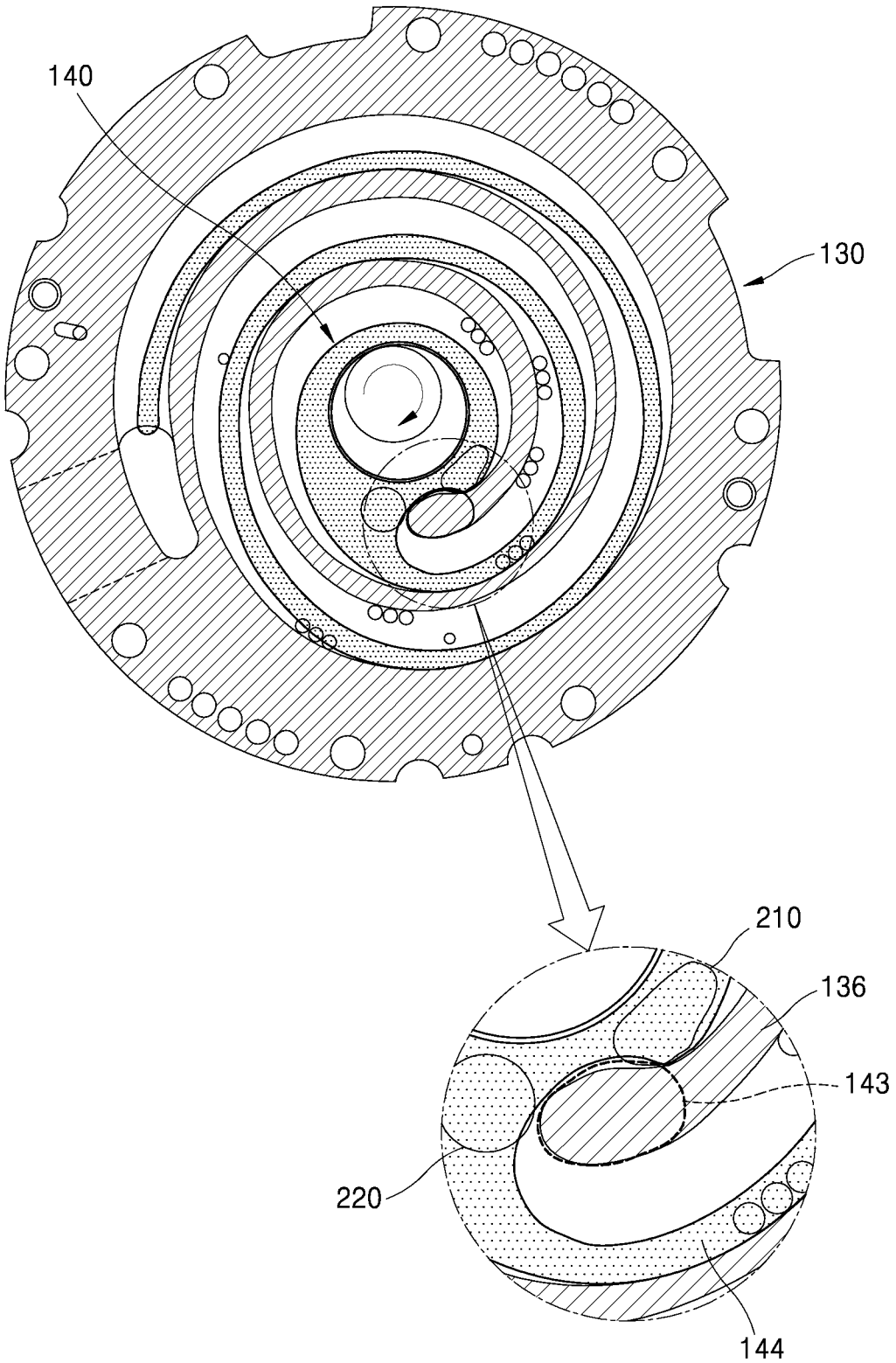

FIG. 16 is a view illustrating a state in which the crank angle of FIG. 15 increases 10° in the clockwise direction, and it may be seen that the orbiting wrap 144 and the communication groove 143 rotate 10° with respect to the fixed wrap 136 and the discharge holes 210 and 220. In the state illustrated in FIG. 16, the second discharge hole 220 enters the inside of the second compression chamber, and the refrigerant compressed in the second compression chamber is discharged through the second discharge hole 220. However, it may be seen that an area at which the second discharge hole 220 overlaps the inside of the second compression chamber is very small. Although the second discharge hole 220 enters the inside of the second compression chamber, as an open area is small, a compressed refrigerant may not be smoothly discharged only through the second discharge hole 220.

Referring to a position of the communication groove 143 in FIG. 16, the communication groove 143 is exposed upward from the fixed wrap 136, and the communication groove 143 deviates from the fixed wrap 136 and is exposed toward the inside of the second compression chamber. In such a state, the compressed refrigerant flows through the communication groove of a portion of the communication groove 143 exposed to the inside of the second compression chamber and moves to a space above the fixed wrap 136 via the communication groove 143. At this time, the first discharge hole 210 enters the space above the fixed wrap 136.

Accordingly, after the refrigerant compressed in the second compression chamber is moved through the communication groove 143 to the space under which the first discharge hole 210 enters, the refrigerant may be discharged through the first discharge hole 210. As a result, in the state illustrated in FIG. 16, the refrigerant compressed in the second compression chamber may be discharged through the second discharge hole 220 and also discharged through the first discharge hole 210 at the same time. At this time, it may be confirmed that an open area of the first discharge hole 210 is greater than an open area of the second discharge hole 220.

Figure 17:
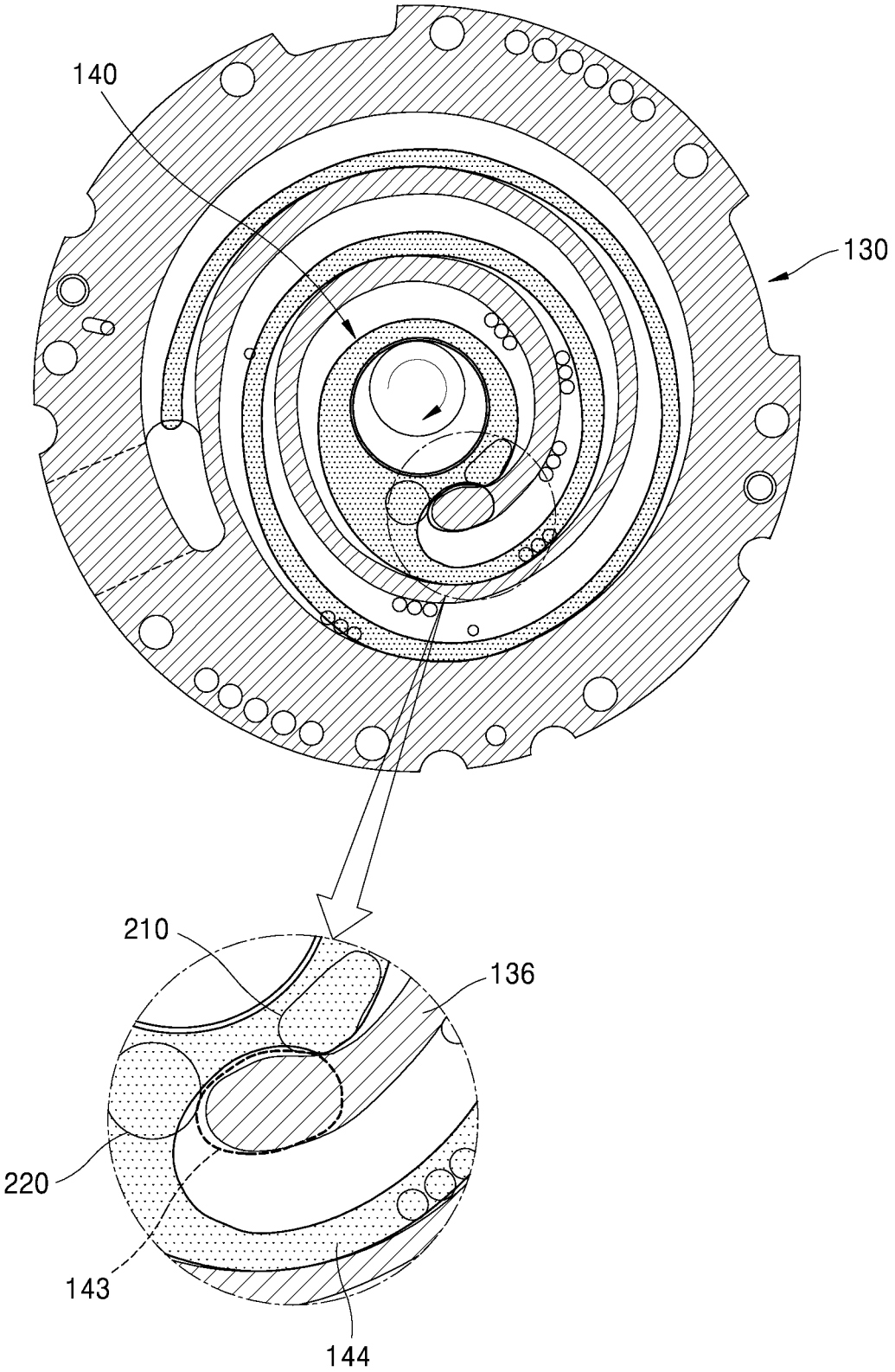

FIG. 17 is a view illustrating a state in which the crank angle of FIG. 16 increases 10° in the clockwise direction and the orbiting wrap 144 and the communication groove 143 rotate 10° more with respect to the fixed wrap 136 and the discharge holes 210 and 220 illustrated in FIG. 16. In comparison to FIG. 16, it may be confirmed that an open area of the second discharge hole 220 is increased and the second compression chamber and the space above the fixed wrap in FIG. 16 are connected. Referring to a position of the communication groove 143, as an upper portion and a lateral portion (left portion in the drawing) of the communication groove 143 deviate from the fixed wrap 136, it may be seen that the compressed refrigerant in the second compression chamber may also flow through the communication groove to a region to which the first discharge hole 210 is exposed. Accordingly, even in this state, the refrigerant in the second compression chamber is discharged through the second discharge hole 220 and simultaneously discharged through the first discharge hole 210.

Figure 18:
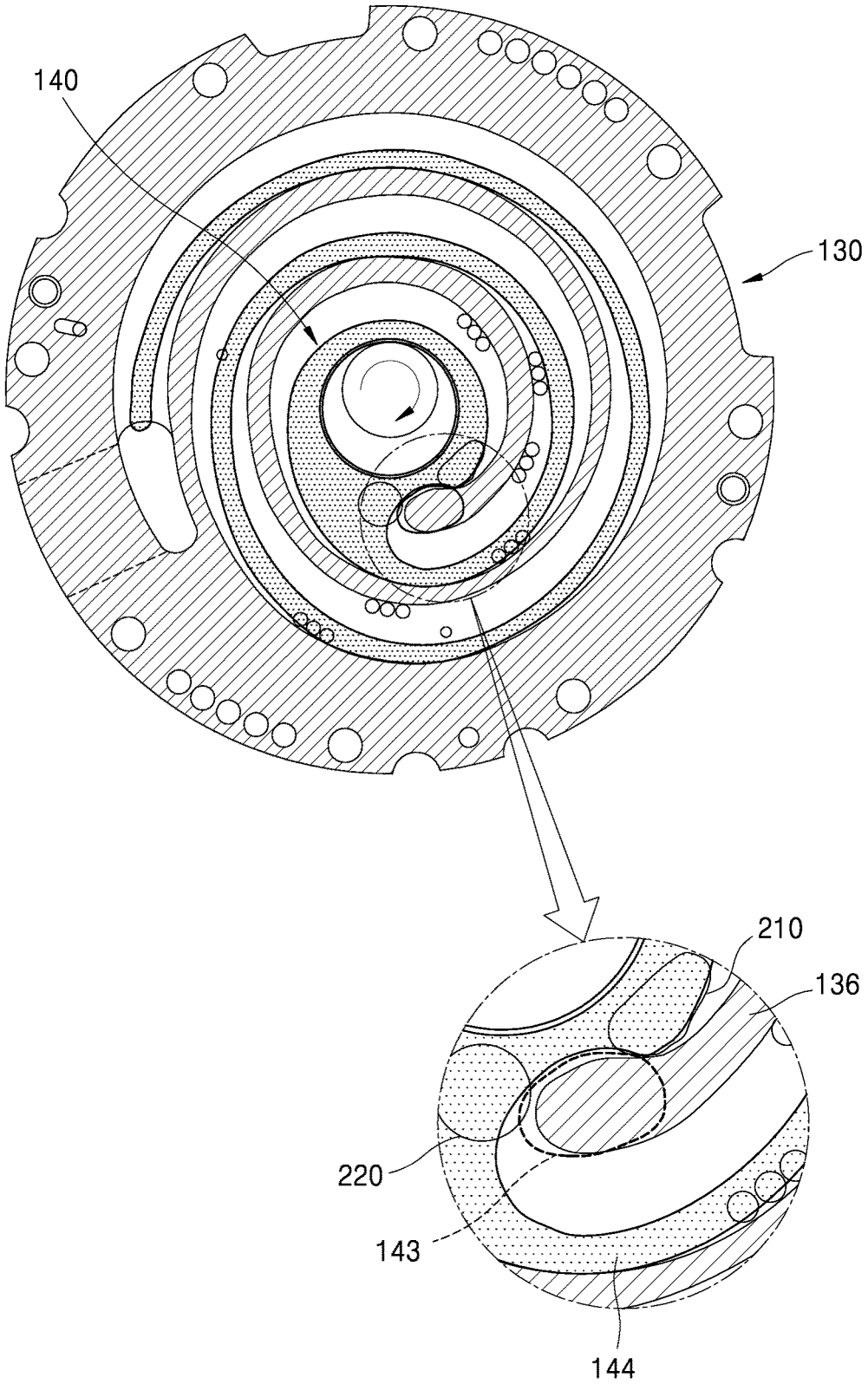

FIG. 18 is a view illustrating a state in which the crank angle of FIG. 17 increases 10° in the clockwise direction. Referring to FIG. 18, it may be seen that the open area of the second discharge hole 220 of the second compression chamber is increased, and at this time, the upper portion and the lateral portion of the communication groove 143 deviate from the fixed wrap 136. However, in the state illustrated in FIG. 18, the open area of the first discharge hole 210 toward the inside of the second compression chamber is decreased. However, as the first discharge hole 210 is connected to the second compression chamber even without the communication groove 143, an effect caused by the communication groove 143 is not great.

Referring to the first compression chamber in the state illustrated in FIG. 18, it may be seen that the first discharge hole 210 is in a state immediately before being opened to the compression chamber. In other words, the first discharge hole 210 is in the state immediately before the first discharge hole 210 enters an inside of the first compression chamber, and when the crank angle further increases in the clockwise direction in this state, discharge from the first compression chamber is started.

Figure 19:
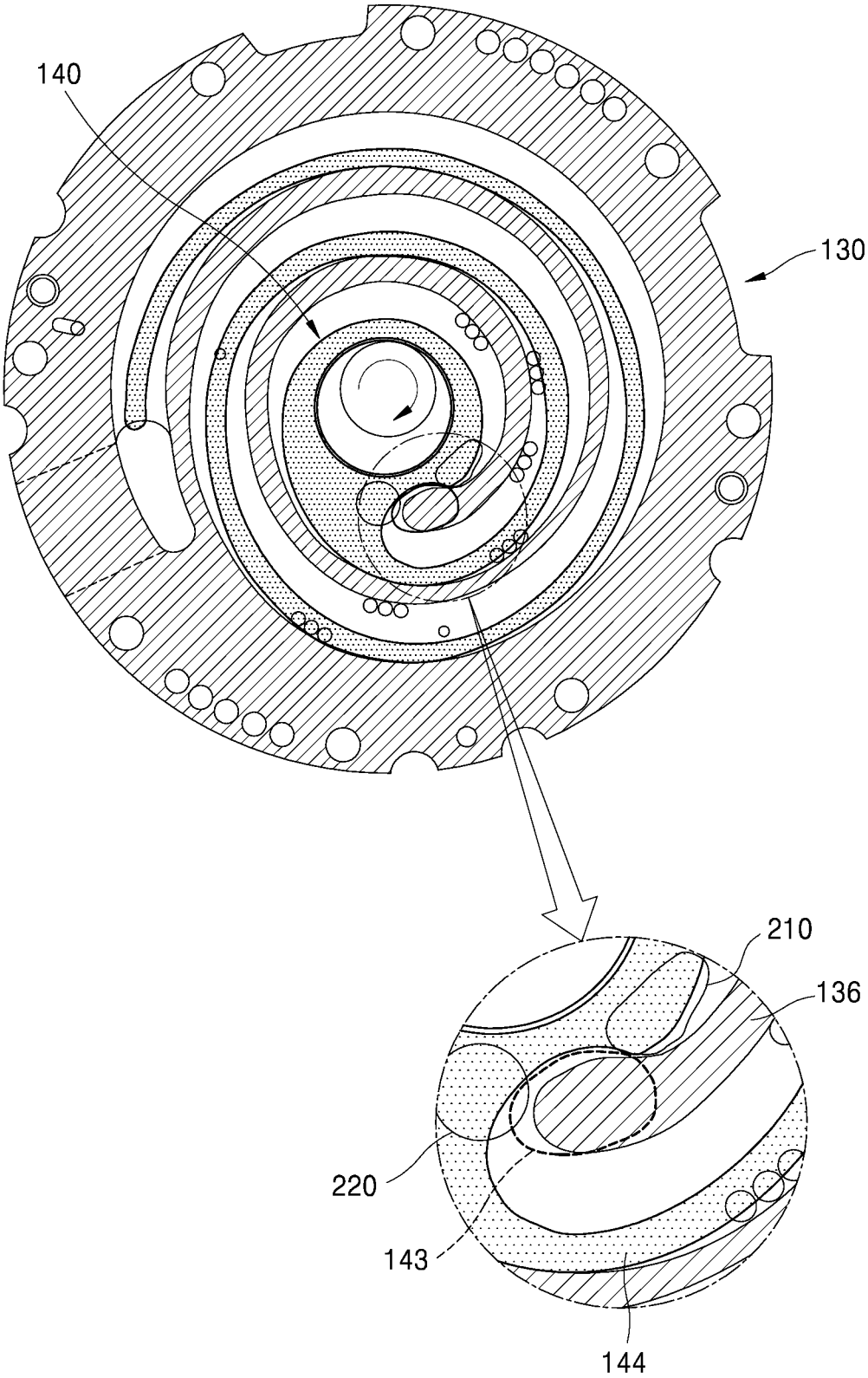

FIG. 19 is a view illustrating a state in which the crank angle of FIG. 18 increases 10° in the clockwise direction. Referring to FIG. 18, the open area of the second discharge hole 220 of the second compression chamber is increased, and even in the case of the first compression chamber, it may be seen that the first discharge hole 210 enters the inside of the first compression chamber, and thus, the discharge of the first compression chamber is performed.

At this time, it may be seen that the upper portion and the lateral portion of the communication groove 143 deviate from the fixed wrap 136 similar to the state illustrated in FIG. 17. However, as the open area of the first discharge hole 210 toward the second compression room is very small similar to the state illustrated in FIG. 16, an effect caused by the communication groove 143 is not great.

Figure 20:
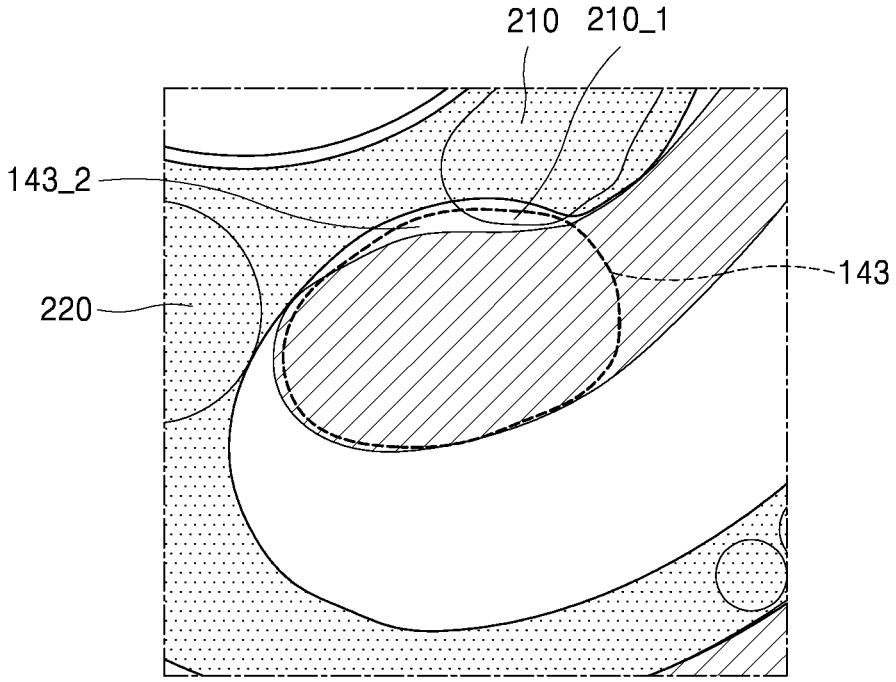
FIG. 20 is an enlarged view for explaining movement of a refrigerant through a communication groove of the scroll compressor according to an embodiment.
Figure 20:
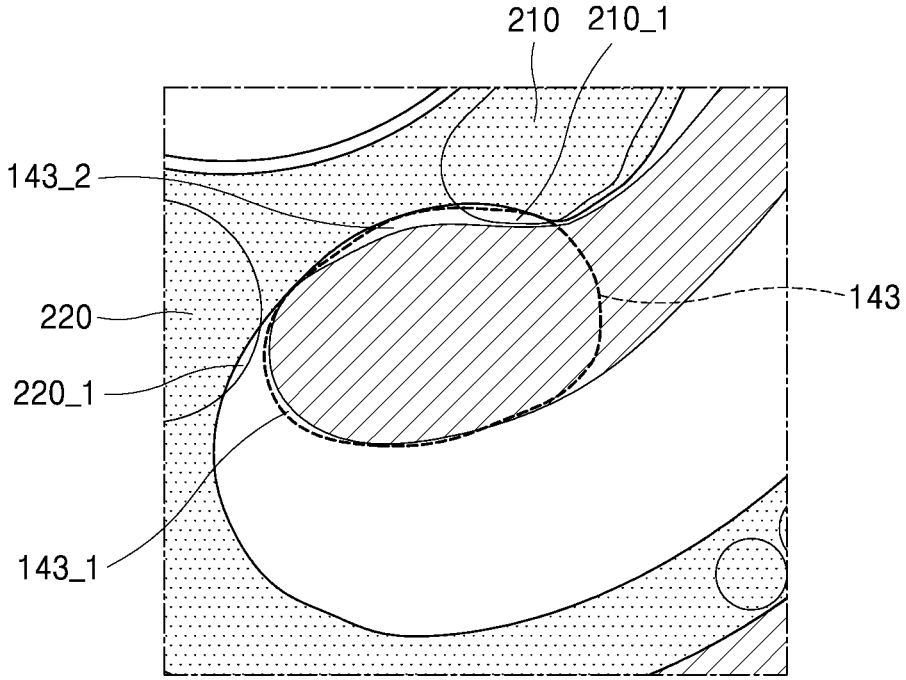

FIG. 20 is an enlarged view for explaining movement of a refrigerant through the communication groove of the scroll compressor according to an embodiment. As illustrated in the drawing, at the discharge start time, there are no regions in which both of the second discharge hole 220 and the communication groove 143 overlap second compression chamber C2.

When the orbiting scroll 140 additionally rotates at the discharge start time, a region at which the second discharge hole 220 enters the inside of the second compression chamber C2 is generated. The region at which the second discharge hole 220 enters the inside of the second compression chamber C2 is referred to as an open area 220_1 of the second discharge hole. The open area is increased by an orbiting angle of the orbiting scroll 140 being increased.

However, at an initial stage of the discharge (immediately after the discharge starts), as the open area 220_1 of the second discharge hole 220 is small, discharge resistance is high, and thus, it is difficult to secure sufficient discharge performance using only the second discharge hole 220. To compensate for this, embodiments are provided such that a refrigerant compressed in the second compression chamber C2 is also discharged through the first discharge hole 210 via the communication groove 143. The communication groove 143 is formed in the form of a recessed groove in the orbiting end plate 142 of the orbiting scroll 140, and a shape in which the communication groove 143 overlaps the fixed wrap 136 is changed according to an orbiting movement of the orbiting scroll 140.

As illustrated in the drawing, at the discharge start time, as there are no regions in which the communication groove 143 overlaps the second compression chamber C2, a refrigerant does not move through the communication groove 143. However, when the orbiting scroll 140 additionally rotates at the discharge start time, the communication groove 143 deviates from the fixed wrap 136 such that a region in which the communication groove 143 overlaps the second compression chamber C2 is generated.

When the crank angle increases 10° more from that of the crank angle at a time at which discharge is started, a region in which the communication groove 143 overlaps the second compression chamber C2 is generated, and this region is referred to as a communication inlet 143_1. In addition, a region in which the communication groove 143 overlaps a first compression chamber C1 is referred to as a communication outlet 143_2.

Accordingly, after the refrigerant in the second compression chamber C2 flows into the communication outlet 143_1 and flows over the fixed wrap, the refrigerant may flow into the first compression chamber C1 through the communication outlet 143_2 and be discharged from the first compression chamber C1 through the first discharge hole 21.

In the case of this embodiment, although opening of the discharge hole and movement of a refrigerant through the communication groove are simultaneously started, as the form of the communication groove may be changed, the movement of the refrigerant through the communication groove may also be started before the discharge hole opens.

As described above, in the scroll compressor according to embodiments, as the communication groove 143 in the form of the recessed groove is formed in an inner surface of the orbiting end plate 142, the refrigerant compressed in the second compression chamber may be discharged through the first discharge hole 210 such that there is an effect in that discharge loss is reduced at an initial stage of the discharge of the second compression chamber at which the open area of the second discharge hole 220 is small.

In addition, as the communication groove is disposed in a section of the compression chamber at which the refrigerant is excessively compressed, the excessively compressed refrigerant may also be moved to another compression chamber. In this case, there is an effect in that excessive compression of a refrigerant is prevented using the communication groove.

Figure 21A:
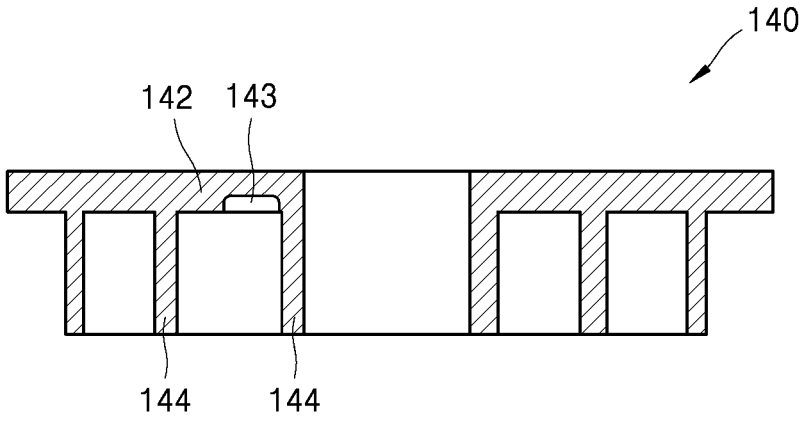
FIGS. 21A-21B are cross-sectional views illustrating shapes of the communication groove of the scroll compressor according to an embodiment.
Figure 21B:
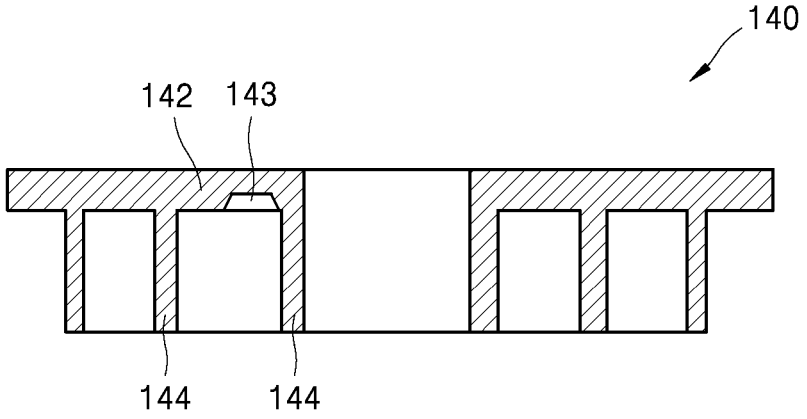

FIGS. 21A-21B are cross-sectional views illustrating shapes of the communication groove of the scroll compressor according to embodiments. As illustrated in the drawing, the communication groove 143 is formed in the inner surface of the orbiting end plate 142 between the orbiting wrap 144 of the orbiting scroll 140. A side surface and a bottom surface of the communication groove 143 may be connected in a round shape, as illustrated in FIG. 21A, or the side surface thereof be obliquely formed so that the compressed refrigerant may effectively move through the communication groove 143. This is to reduce a flow resistance of a refrigerant flowing into the communication groove 143 and a flow resistance of a refrigerant flowing out of the communication groove 143. This is because the flow resistance of the compressed refrigerant moving through the communication groove 143 is relatively high when the side surface thereof is formed to be perpendicular to the bottom surface thereof.

Figure 22:
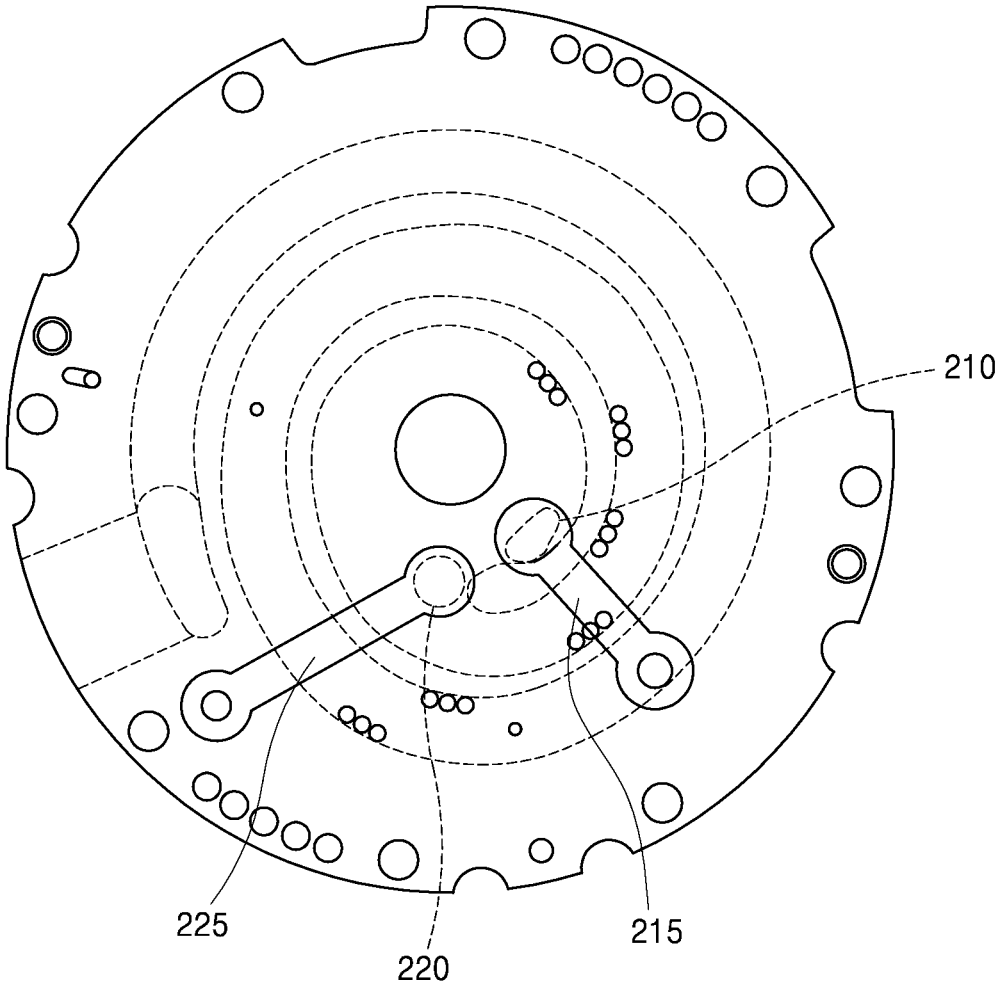
FIG. 22 is a view illustrating a structure of a discharge valve according to an embodiment.
Figure 23:
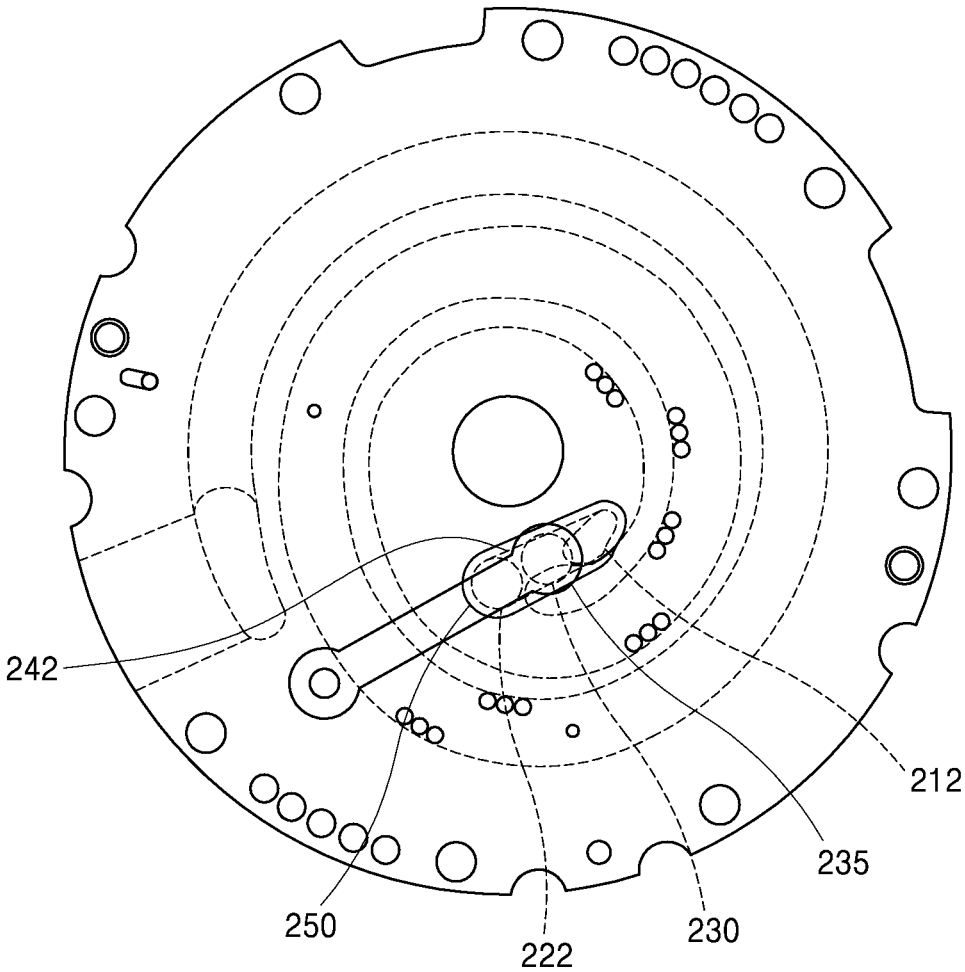
FIG. 23 is a view illustrating a structure of a discharge valve according to another embodiment.

FIG. 22 is a view illustrating a structure of a discharge valve according to an embodiment. FIG. 23 is a view illustrating a structure of a discharge valve according to another embodiment.

As described above, the scroll compressor according to embodiments may include the first discharge hole that discharges the refrigerant compressed in the first compression chamber and the second discharge hole that discharges the refrigerant compressed in the second compression chamber, and the first discharge hole and the second discharge hole may be formed in the fixed end plate of the fixed scroll.

As illustrated in FIG. 22, the first discharge hole 210 and the second discharge hole 220 may be formed in a form of a through hole which passes through the fixed end plate. In this case, each of the first discharge hole 210 and the second discharge hole 220 may include a through hole in a shape in which a discharge inlet and a discharge outlet have a same shape. Such a shape is advantageous for processing the discharge hole.

In the case of this embodiment, a first discharge valve 215 and a second discharge valve 225 respectively configured to open and close the first discharge hole 210 and the second discharge hole 220 may be separately provided.

In another embodiment, as illustrated in FIG. 23, a first discharge inlet 212 and a second discharge inlet 222 may be connected by a communication path such that discharge may be performed through one discharge outlet 230. Such a structure has an advantage in that the number of discharge valves may be decreased.

Figure 24:
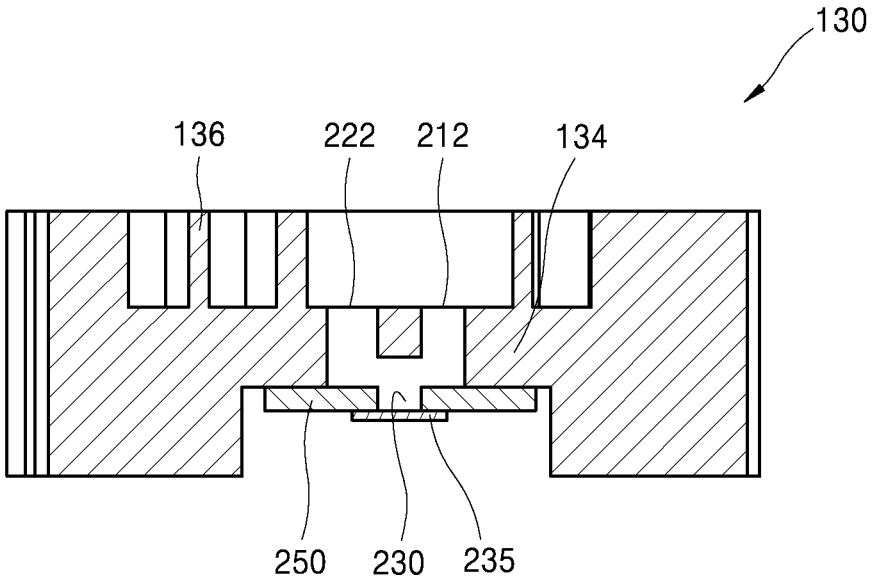
FIG. 24 is a cross-sectional view of the discharge valve illustrated in FIG. 23.

FIG. 24 is a cross-sectional view illustrating a structure of the discharge valve illustrated in FIG. 23. A communication path 240 has to be formed in the fixed end plate 134 to allow the first discharge inlet 212 and the second discharge inlet 222 to be combined in the fixed end plate 134 and to perform discharge through one discharge outlet 230.

As illustrated in the drawing, a method for processing the above structure is for through holes corresponding to shapes of the first discharge inlet 212 and the second discharge inlet 222 to be formed by passing through the fixed end plate 134, and then a communication path groove 242, which connects the first discharge inlet 212 and the second discharge inlet 222, to be processed. The communication path groove 242 may be processed in a form of a groove in a rear surface of the fixed end plate 134 such that the communication path groove 242 does not pass through the fixed end plate 134. In addition, a cover plate 250 having a shape in which the first discharge inlet 212, the communication path groove 240, and the second discharge inlet 222 are combined and including one discharge outlet 230 may be coupled to the rear surface of the fixed end plate 134. A discharge valve 235 may be coupled to the discharge outlet 230.

Through such a structure, a structure in which the first discharge inlet 212 and the second discharge inlet 222 are connected to one discharge outlet 230 may be realized. Such a structure has an advantage in that a position and a shape of the discharge outlet 230 may be designed to be free from positions and shapes of the first discharge inlet and the second discharge inlet, and allow the number of valves to be decreased, and thus, there is an effect in that noise due to a valve operation is reduced.

As described above, a scroll compressor according to embodiments may provide a structure capable of increasing compression rates of a first compression chamber formed between an outer surface of a fixed wrap and an inner surface of an orbiting wrap and a second compression chamber formed between an inner surface of the fixed wrap and an outer surface of the orbiting wrap. At this time, a refrigerant compressed in the second compression chamber may also be discharged through the first discharge hole at an initial stage of discharging the refrigerant compressed in the second compression chamber. Accordingly, even when an open area of a second discharge hole is small at the initial stage of the discharge of the second compression chamber, there is an effect in that an over-compression loss due to a discharge delay may be decreased using the first discharge hole.

In addition, a scroll compressor according to embodiments provides a structure in which a first discharge hole configured to discharge a refrigerant compressed in the first compression chamber and a second discharge hole configured to discharge the refrigerant compressed in the second compression chamber are connected to one discharge outlet, thereby having an effect in that the number of discharge valves may be decreased.

Embodiments disclosed herein are directed to a scroll compressor including a fixed scroll and an orbiting scroll capable of decreasing a discharge delay at an initial stage of discharging a refrigerant compressed in a compression room. Embodiments disclosed herein are also directed to a scroll compressor capable of decreasing the number of discharge valves by connecting a plurality of discharge holes to one discharge outlet.

Embodiments disclosed herein provide a scroll compressor having a first compression chamber and a second compression chamber formed between a fixed scroll and an orbiting scroll that may include a structure in which a refrigerant compressed in the second compression chamber is discharged through a communication groove formed in an inner surface of the orbiting scroll and a discharge hole of the first compression chamber at an initial stage of a discharge of the second compression chamber.

In addition, according to embodiments disclosed herein, a scroll compressor is provided that may include a structure having one discharge outlet and one discharge valve because a first discharge inlet formed in a first compression chamber and a second discharge inlet formed in a second compression chamber may be connected using a communication path in a fixed end plate of a fixed scroll.

This application relates to U.S. application Ser. Nos. 15/830,135, 15/830,161, 15/830,184, 15/830,248, and 15/830,290, all filed on Dec. 4, 2017, which are hereby incorporated by reference in their entirety. Further, one of ordinary skill in the art will recognize that features disclosed in these above-noted applications may be combined in any combination with features disclosed herein.

The above-described embodiments should be considered in a descriptive sense only and not for purposes of limitation, and the scope is defined not by the detailed description but by the appended claims. In addition, the scope encompasses all modifications and alterations derived from meanings, the scope, and equivalents of the appended claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a fixed scroll including a fixed end plate and a fixed wrap;

an orbiting scroll including an orbiting end plate and an orbiting wrap, the orbiting wrap being engaged with the fixed wrap and orbiting with respect to the fixed wrap to form a first compression chamber and a second compression chamber to compress a refrigerant, wherein the fixed scroll includes a first discharge configured to communicate with the first compression chamber and a second discharge configured to communicate with the second compression chamber, and wherein the orbiting scroll includes a communication groove configured to provide selective communication between the first discharge and the second discharge at an initial stage of discharge of one of the first discharge or the second discharge.

2. The scroll compressor of claim 1, wherein the communication groove provides selective communication between the first discharge and the second discharge based on a position of the orbiting scroll.

3. A scroll compressor, comprising:

a fixed scroll including a fixed end plate and a fixed wrap; and an orbiting scroll including an orbiting end plate and an orbiting wrap, the orbiting scroll being configured to perform an orbiting movement about the fixed scroll, wherein a communication groove having a form of a recessed groove is formed in an inner surface of the orbiting end plate; wherein a refrigerant flows through the communication groove according to a state in which the fixed wrap overlaps the communication groove; wherein a first compression chamber is formed between an outer surface of the fixed wrap and an inner surface of the orbiting wrap; wherein a second compression room is formed between an inner surface of the fixed wrap and an outer surface of the orbiting wrap; wherein the fixed end plate of the fixed scroll includes a first discharge hole configured to discharge a refrigerant compressed in the first compression chamber and a second discharge hole configured to discharge a refrigerant compressed in the second compression chamber, and wherein the communication groove is configured to discharge the refrigerant compressed in the second compression chamber at an initial stage of a discharge of the second compression chamber through the communication groove and the first discharge hole.

4. A scroll compressor comprising:

a fixed scroll including a fixed end plate and a fixed wrap, and an orbiting scroll including an orbiting end plate and an orbiting wrap, the orbiting scroll being configured to perform an orbiting movement about the fixed scroll, wherein a communication groove having a form of a recessed groove is formed in an inner surface of the orbiting end plate; wherein a refrigerant flows through the communication groove according to a state in which the fixed wrap overlaps the communication groove; wherein the orbiting wrap orbits while coming into contact with the fixed wrap and compresses a refrigerant introduced into a first compression chamber and a second compression chamber formed on an outer side surface and an inner side surface of the orbiting wrap; and wherein:

the region at which the communication groove overlaps the first compression chamber is a communication inlet;

the region at which the communication groove overlaps the second compression chamber is a communication outlet; and the refrigerant in the first compression chamber flows through the communication groove to the second compression chamber.

5. A scroll compressor, comprising:

a fixed scroll including a fixed end plate and a fixed wrap; and an orbiting scroll including an orbiting end plate and an orbiting wrap, the orbiting scroll being configured to perform an orbiting movement about the fixed scroll, wherein a communication groove having a form of a recessed groove is formed in an inner surface of the orbiting end plate, wherein a refrigerant flows through the communication groove according to a state in which the fixed wrap overlaps the communication groove; wherein the orbiting wrap orbits while coming into contact with the fixed wrap and compresses a refrigerant introduced into a first compression chamber and a second compression chamber formed on an outer side surface and an inner side surface of the orbiting wrap; and wherein:

the region at which the communication groove overlaps the second compression chamber is a communication inlet;

the region at which the communication groove overlaps the first compression chamber is a communication outlet; and the refrigerant in the second compression chamber flows through the communication groove to the first compression chamber.

6. A scroll compressor, comprising:

a fixed scroll including a fixed end plate and a fixed wrap; and an orbiting scroll including an orbiting end plate and an orbiting wrap, the orbiting scroll being configured to perform an orbiting movement about the fixed scroll, wherein a communication groove having a form of a recessed groove is formed in an inner surface of the orbiting end plate; wherein a refrigerant flows through the communication groove according to a state in which the fixed wrap overlaps the communication groove; wherein the orbiting wrap orbits while coming into contact with the fixed wrap and compresses a refrigerant introduced into a first compression chamber and a second compression chamber formed on an outer side surface and an inner side surface of the orbiting wrap; wherein the fixed end plate includes a first discharge hole configured to discharge a refrigerant compressed in the first compression chamber and a second discharge hole configured to discharge a refrigerant compressed in the second compression chamber; wherein the communication groove provides a path through which the refrigerant compressed in the second compression chamber flows to the first compression chamber; and wherein the refrigerant compressed in the second compression chamber is discharged through the second discharge hole and the first discharge hole.

7. A scroll compressor, comprising:

a fixed scroll including a fixed end plate and a fixed wrap; and an orbiting scroll including an orbiting end plate and an orbiting wrap, the orbiting scroll being configured to perform an orbiting movement about the fixed scroll, wherein:

a first compression chamber is formed between two contact points generated by an inner side surface of the fixed wrap coming into contact with an outer side surface of the orbiting wrap;

a second compression chamber is formed between two contact points generated by an outer side surface of the fixed wrap coming into contact with an inner side surface of the orbiting wrap;

the fixed end plate includes a first discharge hole configured to discharge a refrigerant compressed in the first compression chamber and a second discharge hole configured to discharge a refrigerant compressed in the second compression chamber; and the orbiting end plate includes an inner surface on which the compression chamber is formed and which is provided with a communication groove that provides a path configured to move the refrigerant in the second compression chamber toward the first discharge hole.

8. The scroll compressor of claim 7, wherein the communication groove is configured such that the refrigerant in the second compression chamber is moved toward the first discharge hole at a discharge start time at which the compressed refrigerant in the second compression chamber is discharged through the second discharge hole.

9. The scroll compressor of claim 8, wherein an area of a communication inlet, which is a region at which the communication groove overlaps the second compression chamber, increases at the discharge start time.

10. The scroll compressor of claim 9, wherein the communication groove is formed in a shape having a region which overlaps the first compression chamber, and wherein a refrigerant introduced into the communication inlet is moved through the communication groove to a communication outlet.

11. The scroll compressor of claim 7, wherein each of the first discharge hole and the second discharge hole includes a through hole in which a shape of a discharge inlet formed in an inner surface of the fixed end plate and a shape of a discharge outlet formed in an outer surface of the fixed end plate are the same.

12. The scroll compressor of claim 7, wherein the first discharge hole and the second discharge hole each include:

a first discharge inlet and a second discharge inlet formed in an inner surface of the fixed end plate;

a communication path that connects the first discharge inlet and the second discharge inlet in the fixed end plate; and a discharge outlet connected to the communication path.

13. The scroll compressor of claim 7, wherein a protrusion is formed on an inner circumferential surface of an inner end of the fixed wrap;

a recess formed in an outer circumferential surface of a rotary shaft coupler of the orbiting wrap and configured to come into contact with the protrusion to form a compression chamber.

* * * * *